US010557684B2

(12) United States Patent
Hughes et al.

(10) Patent No.: US 10,557,684 B2
(45) Date of Patent: Feb. 11, 2020

(54) SHOT INDICATING RESETTING TRIGGER FIREARM TRAINING SYSTEM

(71) Applicants: Michael F. Hughes, Maple Falls, WA (US); Jack Kettlestrings, Everson, WA (US); Gregory Davis, Ferndale, WA (US); Britt Lentz, Everson, WA (US)

(72) Inventors: Michael F. Hughes, Maple Falls, WA (US); Jack Kettlestrings, Everson, WA (US); Gregory Davis, Ferndale, WA (US); Britt Lentz, Everson, WA (US)

( * ) Notice: Subject to any disclaimer, the term of this patent is extended or adjusted under 35 U.S.C. 154(b) by 266 days.

(21) Appl. No.: 15/666,623

(22) Filed: Aug. 2, 2017

(65) Prior Publication Data

US 2019/0041164 A1 Feb. 7, 2019

(51) Int. Cl.
*F41G 3/26* (2006.01)
*F41A 3/66* (2006.01)

(52) U.S. Cl.
CPC ..... *F41G 3/2655* (2013.01); *F41A 3/66* (2013.01)

(58) Field of Classification Search
CPC ..... F41A 33/00; F41A 33/02; F41A 33/04; F41A 33/06; F41A 3/66; F41A 11/02; F41A 19/16; F41C 23/10
See application file for complete search history.

(56) References Cited

U.S. PATENT DOCUMENTS

| | | | | |
|---|---|---|---|---|
| 7,753,679 | B1 * | 7/2010 | Schuetz | F41A 33/00 42/49.02 |
| 8,556,628 | B1 * | 10/2013 | Baxter | F41A 19/10 345/156 |
| 2005/0130739 | A1 * | 6/2005 | Argentar | A63F 13/02 463/36 |
| 2018/0149443 | A1 * | 5/2018 | Dottle | F41A 33/02 |

* cited by examiner

*Primary Examiner* — Timothy A Musselman
(74) *Attorney, Agent, or Firm* — Michael Hughes

(57) ABSTRACT

A firearm training tool having a shot indicating system configured to provide a training rifle with a shot indicating laser activated by pressing a trigger rearward.

13 Claims, 27 Drawing Sheets

SHOT INDICATING RESETTING TRIGGER FIREARM TRAINING SYSTEM

RELATED APPLICATIONS

This application claims priority benefit of U.S. Provisional Ser. Nos. 61/236,763, filed Aug. 25, 2009 and 61/236,744, filed Aug. 25, 2009 and Ser. No. 12/861,388 filed Aug. 23, 2010 and Ser. No. 14/178,144 filed Feb. 11, 2014 which are all fully incorporated by reference.

BACKGROUND OF THE DISCLOSURE

Firearms have a plurality of uses in society, ranging from self-defense, military and law enforcement use, general personal use, and competitive shooting, as well as Second Amendment privileges for proper civilian checks and balances upon government. Shooting is generally enjoyed by many individuals cutting across various social strata. Mastery of shooting, in particular for pistol craft, is an art form requiring many athletic, psychological and physiological elements for the elusive objective of perfecting one's skill with a pistol.

An element of training with a firearm, in one particular form a pistol, requires dedication and commitment by a shooter. One form of practice consists of live fire whereby actual rounds are shot at a range of some sort at a target or an array of targets. Live fire, of course, is what is commonly envisioned with regard to practice and training. However, ammunition can be expensive, and even when a shooter reloads, there is a certain expense and time investment involved in reloading. An alternative form of practice is referred to as "dry firing". When a shooter engages in dry firing, no rounds are expelled through the gun and various aspects of pistolcraft can be trained, such as transitions, reloads, footwork and other elements of pistolcraft. One element of pistolcraft and firearms handling in general relates to trigger mechanics. In general, trigger mechanics is the study of the pressing of a trigger with minimal undesirable sight movement.

Of course triggered mechanics does not work in isolation and other elements of shooting such as grip, site alignment, site picture play a heavy role in speed and accuracy with a firearm. Further, with regard to dynamic shooting, the acceleration of the body, accelerating the body out of a shooting position, providing proper follow-through of pressing the trigger prior to exiting a shooting position or transitioning off the target, all are examples of skill sets that must be trained to optimize a shooting performance. Dry firing provides an opportunity to train many of these elements. However, dry firing with a regular pistol (without any ammunition) is problematic where recoil management is not trained while dry firing. Therefore, live fire will always play a heavy role when training. Recoil management is only one element of shooting whereby the above mentioned skill-sets all can be trained while dry firing. Dry firing further can be conducted in many more locations whereas live fire is generally restricted to some form of a shooting range. However, a traditional weakness with dry firing is to have any confirmation of the actual hits when the trigger breaks. In other words, dry firing is a training technique ultimately leading to actual live fire in competition or in a self-defense application. Therefore, in order to attain the most gains and benefit from dry firing there must be some form of confirmation that the intended target is indeed in alignment with the axes of the muzzle when the trigger is broken.

With traditional live fire and dry firing training regimens, a shooter must practice various elements of pistolcraft and try to determine which causal factors are in the most need of improvement. While engaging in live fire, the impact of a bullet is an indicator of how well the shot was placed. Of course the impact of the bullet can indicate a missed shot, or a shot which is not at a perfect center location of the intended target. However, firearms create a certain degree of recoil and noise. One common occurrence among shooters is to develop a flinch. A flinch is a general natural response by the body which anticipates the recoil. Flinching involves undesirable anticipatory body movements such as pressing the gun downward prior to the shot firing causing a "six o'clock" or low shot. However, it can be difficult to determine the causal effects of a missed shot or any general shot not perfectly-placed or not of acceptable accuracy.

Dry firing removes the element of recoil and allows a shooter to train various skill sets of shooting. However, there is no projectile when dry firing to gauge the impact of a shot if one were to be fired. Other training tools are available, such as air soft guns and BB guns, which provide a low-cost alternative for sending a projectile out of a gun for indicating a hit or a miss or otherwise indicating the degree of accuracy of a shot. However, air soft guns expel the BBs, which must be picked up and still create a certain amount of noise which can be unacceptable in enclosures. For example, an air soft gun within a household can be very distracting and annoying to other members of the household, such as the shooter's family.

Therefore, there currently exists no training tool in the prior art which can identify feedback in a shooter's performance while dry firing that is, economical, produces little noise and is further enjoyable and sustainable to the shooter that is training. Further, there is no effective training tool for gauging trigger mechanics and more specifically ascertaining whether a shooter has properly "taken-up" or otherwise partially depressed the trigger prior to the breaking point of the trigger. Take-up is an important element of shooting where a trigger is prepped and a certain amount of force is placed thereon prior to applying further force to break the trigger and accelerate the firing pin to the primer of a bullet thereby initiating the firing sequence. Because a lot of actual shooting occurs in a dynamic fashion, for example where a shooter is drawing the pistol and firing upon a target, it is difficult for a trainer or the shooter themselves to evaluate whether the trigger was properly prepped prior to firing and after the decision has been made by the shooter to place a bullet upon the target with the intention of destroying the target and further having the awareness of what is behind the target. Described herein is an embodiment to provide an indicator with a positional sensor switch to indicate whether a requisite amount of force and/or travel is placed upon the trigger prior to breaking the trigger. For example, when conducting a transition from one target to another where a shooter must rotate their upper body to a certain degree to acquire the new target, the shooter generally must apply some degree of pre-force upon the trigger prior to attaining site alignment and site picture upon the target. Often times, many shooters will not shoot off the reset of the gun, or otherwise completely disengage their finger from the trigger after a shot on a first target and not touch the trigger until the gun is completely on the second target and the gun has fully decelerated to a stop. Not only does it require time to apply force and reposition the trigger to prep it and then shoot it, oftentimes this practice results in sloppy trigger mechanics where the trigger is "slapped" or otherwise not pressed rearwardly substantially along the line of the center axis of the muzzle and hence the gun will rotate causing a missed shot or at the very least a less accurate shot. In particular with law-enforcement, a majority of shots from law enforcement officers are misses. Of course a missed shot in an urban or otherwise populated environment is a tremendous liability. Law-enforcement firearms instructors need a tool that can be used indoor and outdoor, is reliable, and provides the operating mechanisms for indicating proper take-up for a trigger, indicating the muzzle orientation when the trigger is broken and further provide other operational benefits such as allowing simulated reloads, draws and other shooting skill sets. Described in detail herein are various embodiments shown in one form which provide an economical, reliable and simple dry firing tool that can be in combination of the above mechanisms or have subsets of all these mechanisms for a usable embodiment.

Shooting mechanics must be trained and many problems with the shooter's ability can be attributed to certain specific mechanical issues with their shooting in conjunction with larger systemic issues described further below. With regard to the specific mechanical issues, grip, stance, eye focus, and trigger mechanics play a large role in a shooter's performance. In particular, grip and stance play a heavy role related to recoil management. However, of course, all of these elements work in conjunction to support a solid performance by the shooter. One observed problem with many shooters is a lack of isolation of the shooter's most dominant area which requires strengthening (which is merely a euphemism for the shooter's weaknesses). Oftentimes one strength can mask another weakness within the shooter. For example, oftentimes a very solid grip can mask trigger mechanic issues. Further, a shooter can have a very solid index and be very skilled in viewing a target and bring the sight picture with proper sight alignment on the target very quickly without a visual confirmation of the site alignment. A strong index can cause the shooter to gradually lose awareness of their sight and rely only on their strong indexing ability. Likewise, a strong grip can mask trigger mechanic problems which may not unfold until the shooter must shoot strong hand only (with a single hand, namely the shooter's dominant hand) or in particular, weak hand only.

Therefore, it can be appreciated that improving one's shooting ability requires a multi-faceted approach of analyzing all of the elements of shooting and the interaction of skill sets with one another, and further dissecting the areas which require strengthening and focusing on these areas. As mentioned above, live fire will test a shooters recoil management. As noted above, dry firing alone where the shooter only has his site picture to determine if the shot was good and no other external indicator, they cannot completely confirm that the shooter is trained properly and actually hit the target. The Applicant has personally witnessed with a proof of concept of this embodiment many skilled shooters may be absolutely marveled at misses upon targets while dry firing when utilizing and emitting a laser that is in alignment with the sites. In other words, many skilled shooters have utilized a tool made pursuant to the teachings of this disclosure and initially thought that the laser was not in alignment with the alignment of the front sight post with respect to centering of the post within the rear sight notch. However, after pressing the laser constantly and lining up the gun upon a target, indeed the laser was not misaligned but certain shooting mechanics of the skilled shooter were not "dialed in" and the laser provided an indication of misses by the shooter. As described further herein, proper training with the device disclosed herein does require a rigorous focus upon the front sight whereby in a preferred form the shooter will only have a general awareness of the laser upon the target in the background. However, empirical analysis has found that the general human factor engineering of the training pistol with the body, and in particular the optical senses of the body, can provide sufficient awareness of the shot placement by the indication of the laser impact while maintaining the full awareness of the sights of the training pistol. Therefore, the training device which in one form is a pistol (and one embodiment can be incorporated with a long gun such as a rifle or shotgun) can train most all elements of pistolcraft with the exception of recoil management. Because recoil management is a function of pure Newtonian physics, where force equals mass times acceleration, it is not possible to train recoil management outside of actual live fire. In other words, there is a tremendous amount of energy developed when a bullet accelerates to very high velocities. The basic momentum equations are of units of mass times velocity. A 124 grain bullet traveling at over 1000 ft. per second creates a certain degree of momentum where the equal and opposite momentum is exerted upon the firearm to the grip of the shooter to the overall body of the shooter down to the shooters feet. Further, the energy of the bullet is a function of the square of the velocity times the mass, but the energy of the bullet creates an equal and opposite force upon the firearm. Therefore, when firing a live round the shooter must learn to endure a certain amount of recoil energy and momentum resulting in an impulse force thereupon the grip of the shooter. Granted, a training device could be utilized to accelerate a mass, such as a heavier mass emulating a projectile having the same momentum, to emulate recoil where the heavier mass had a lower velocity was less of a liability when fired at locations outside of a shooting range. However, it is well-known in shooting disciplines that felt recoil is as much of an art with regard to the dynamics of the gun as it is a science. In other words, the action of the slide, the burn rate of the powder, the length of the barrel, the weight of the bullet, and even the coating of the bullet that can alter the coefficient of friction, and they all play a role in felt recoil along with a plurality of other factors. It is also well-known in shooting semiautomatic pistols that the timing of the gun is unique amongst pistols, and even pistols of the exact same model and caliber, as well as ammunition. The timing of the gun relates to the muzzle flick and the natural resonant frequency of the muzzle being placed back into the proper desired site alignment. A desirable way of timing a gun is to place the front site back into its proper location in a critically damp manner. In engineering parlance a critically damp system places an object in an a desired location without any undesirable oscillations and further at an optimum speed in deceleration. Timing a critically damped system of a pistol in conjunction with the arms, upper body and lower body of a shooter, is a complex interaction between the idiosyncrasies of the pistol and the shooter. In conclusion, recoil management embodies numerous issues and the best way to train recoil management is live fire and actually shooting the shooter's own pistol with their own ammunition in simulated circumstances of competition or self-defense. However, a shooter can train the other elements of shooting to a large degree without live fire.

Disclosed herein is a system of training which projects an indicator, which in one preferred form is a visible laser beam on impact of a simulated trigger break. Further describes an environment that emits an indicator, such as a different colored laser, to indicate whether the trigger is taken up. Also disclosed is a modular system providing for a main slide module that is configured to have different grip modules attached thereto. The grip modules are designed to emulate the idiosyncrasies of different firearms, namely they are functional and not necessarily ornamental elements. The modular element aspect of the unit is such that additional trigger modules can be inserted therein whereby, for example, a trigger that rotates about a cross pin can be replaced, with a trigger that provides transverse movement such as the trigger of a 1911 or the modern wide-body 2011 and all the various derivatives thereof. Further, an adjustment system is provided in one form to adjust the various attributes of a trigger where one goal of the adjustment system is to provide an emulated feel of an actual firearm. Further, in certain training scenarios the adjustment system of a trigger can be such that a heavy trigger requiring a lot of force for the take-up and breaking can be provided for training the strength of the trigger, as well as truly testing the trigger mechanics of the shooter. Further, a very light trigger can be utilized to train a shooter to position their finger in a fully taken-up position without applying unnecessary force which would result in an accidental or unintentional discharge of a real firearm. Of course, the embodiments are shown by way of example, and the claims are intended to be broadly read upon by all other variants embodying the spirit and scope of the claims. Further, the training of locations of such a tool described herein is vast and not yet fully explored at the time of this writing.

Also disclosed herein are various methods and tools providing an array of training techniques to enhance an individual's shooting skills. Of course in the broader scope, some of the techniques can become competitions in themselves and have broader implications and immediate use than just training. However, training is the cornerstone, and the Applicant's motto and mantra is "train hard and train smart". "Train smart" consists of a detailed and thorough understanding of the various potential training responses resulting from a training protocol. "Training hard" requires either pushing the body to some form of fatigue or otherwise a new level of performance to result in adaptation which is more commonly referred to as making gains.

One underlying training principle is to emulate the environment of performance as much as possible, which includes the immediate environment of the footing, targets, temperature and other external circumstance. Another element of the environment is equipment. As noted above, it can be cost-prohibitive to exercise in live fire at all times, and it simply may not be feasible as very few people have immediate access to a range at any given time. Therefore, emulating equipment by way of focusing on the elements which interface directly with the user, such as the grip/handle of the gun, the trigger, and the sights are elements to emulate as much as possible, with further consideration of other aspects such as a magwell which allows insertion of the magazine therein, and a magazine release to emulate and practice dropping a magazine for a reload. Tony Blauer of Blauer Tactical Solutions has stated that in scenario-based training, the goal is to try to do the realist fake stuff if possible. In other words, it is never possible to fully emulate the actual performance environment of a competition or a self-defense situation and anyone engaging in training should understand this inherent limitation. However, emulating a live firearm as much as possible, even with the center of gravity of the firearm, and further utilizing weighted ingots to simulate the moment of inertia of the firearm about the various axes is very desirable. Other practical considerations are emulating an overall frame and slide so as to holster the training device to practice draws, and even further providing an emulated trigger guard to practice picking up the gun off of a surface, such as a table.

Other practical requirements consist of quick breakdown and setup of a training environment. Certain computer simulated training modules having a practice gun that emulates an invisible beam or otherwise receives a beam from, for example, a cathode-ray tube, are expensive, can only be utilized in that particular environment with the external equipment and provide other barriers to entry. In one particular law-enforcement agency known by the Applicant, such an expensive simulated training system cost tens of thousands of dollars (approximately $60,000) and requires extensive setup and calibration of approximately 30 minutes prior to use. Therefore, one consideration of training is to lower the barrier of entry by eliminating setup time where the training device described herein can be used with a plurality of different types of targets in numerous settings, and environments.

A third element of training is to emulate the mental environment as much as possible with various forms of induced stimulus, which in some cases can cause stress with individuals. Performing with a pistol during competition has been known to cause interesting behavior patterns among shooters, causing them to make mental errors which are generally uncharacteristic for the shooter.

One element of the method of training results in physiological adaptation of the body, even to the point of having a asymmetric dilation of the eyes with a dominant eye focused on the front sight, and the weak eye focused at a line of sight adjacent to the front sight line of sight where the weak eye is focusing on the target. An advanced skill is to have one eye focused upon the target and the other eye maintaining a crisp focus on the front sight. Certain corrective lenses have accomplished this element, but it is believed that a rigorous training protocol can actually allow the shooter to maintain a split eye viewpoint and even focus in a chameleon-like manner. Another phenomenon observed by the Applicant is having the pupils vary in dilation to a noticeable degree, where the strong eye has a slightly narrower iris opening and the weak eye (i.e., the non-dominant eye) having a slightly more open iris. This phenomenon is not completely understood, but at the very least has been observed.

The body can also be surgically altered whereby the Applicant has had his trailing foot be altered where the Achilles tendon was completely severed and reattached giving a slightly longer tendon for further range of motion of the foot. The increased range of motion allows for the entire foot to remain on a ground surface with the knee bent forward an additional degree to allow the center of gravity of the Applicant to become lower.

BRIEF DESCRIPTION OF THE DRAWINGS

FIG. 4 shows a side cross-sectional view of the laser module mounted to the grip module with the front weight interposed there between;

DESCRIPTION OF THE PREFERRED EMBODIMENTS

Figure 1:
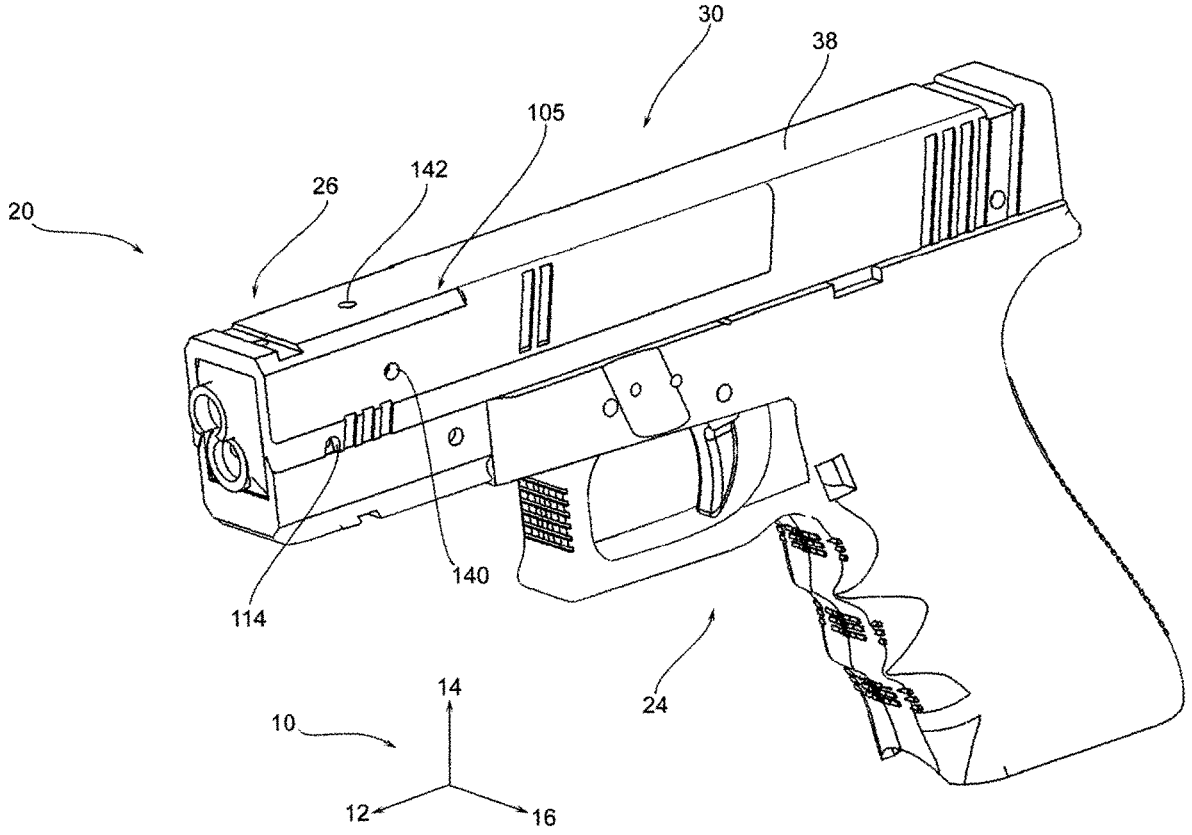
FIG. 1 shows an isometric view of one form of the training pistol.

As shown in FIG. 1 there is a training pistol 20. The training pistol in general comprises a grip portion 22, a trigger region 24 and a site location 26. The operational elements of the training pistol 20 is to provide a grip that in a preferred form will simulate the properties of a real firearm chosen by the shooter of a trigger 24 that substantially simulates the properties of the trigger of a real firearm or otherwise provides certain qualities to enhance trigger mechanics. Further, the sighting system provides for iron sights or even rapid acquisition dot sites (e.g. red dot scopes). In general, the training pistol should substantially emulate a real firearm for proper training purposes.

As an additional element to the pistol 20 there is a feedback system 30 which in one form provides a shot indicating laser, and in an additional form provides a take-up indicator which in one form is a projected laser. The feedback system 30 provides the individual with proper feedback of their shooting mechanics to help ensure proper training.

Before further discussion, one detailed implementation of the above general regions and axis system will be defined. As shown in FIG. 1 the axis system 10 defines a longitudinal axis 12, a vertical axis 14 and lateral axis 16 which, for reference purposes, points in the left direction in reference to the individual handling the training pistol 20. Of course, the substantially opposing lateral direction is referred to herein as the right direction. Of course, the axis system is generally put forth and defined for general reference purposes and is not necessarily intended to be limiting upon the orientation of components and elements described herein.

Figure 2:
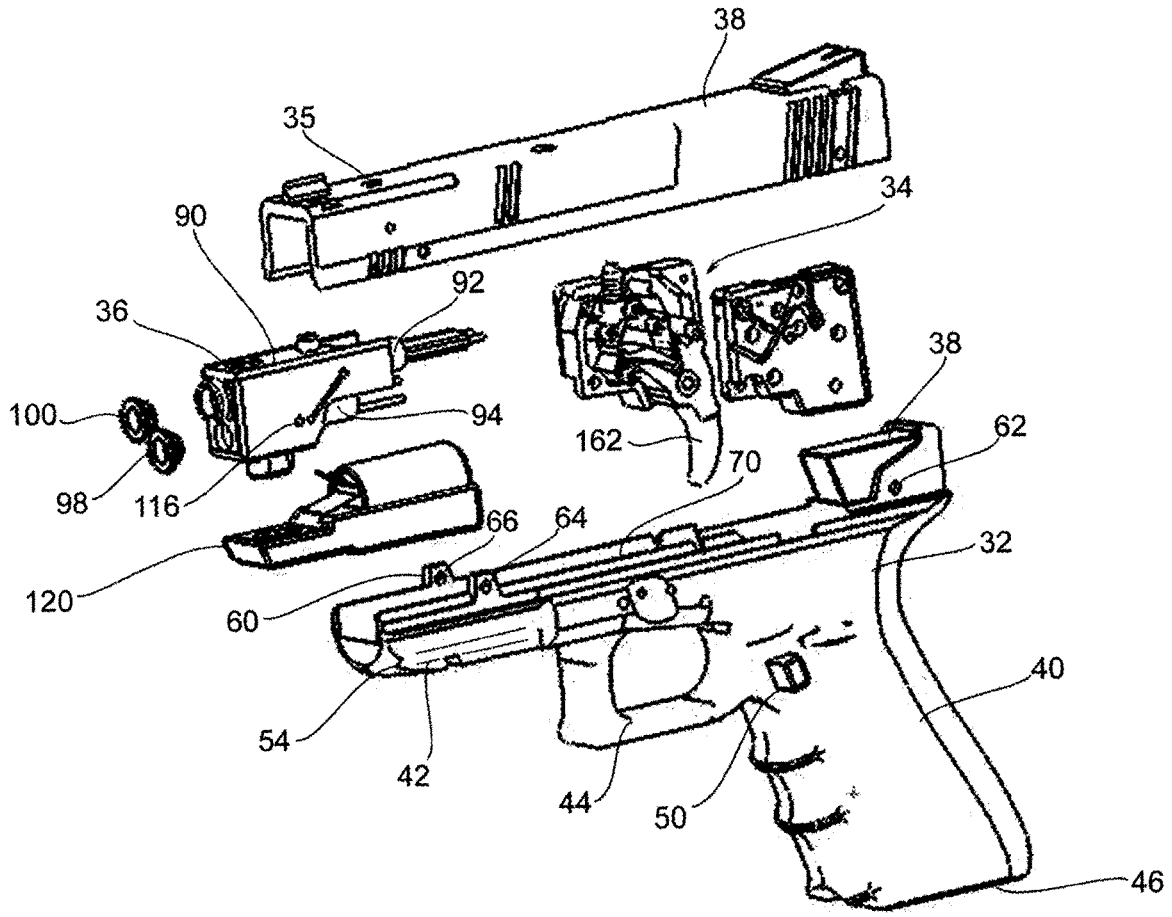
FIG. 2 shows a partially exploded view of the training pistol showing a grip module, a slide module, a laser module and a trigger module.

Now referring to FIG. 2 there is shown an isometric exploded view of one form of an assembly of components. In general one form of assembly of components comprises the Grip module 32, the trigger module 34, the laser module 36 and the slide module 38.

Figure 3:
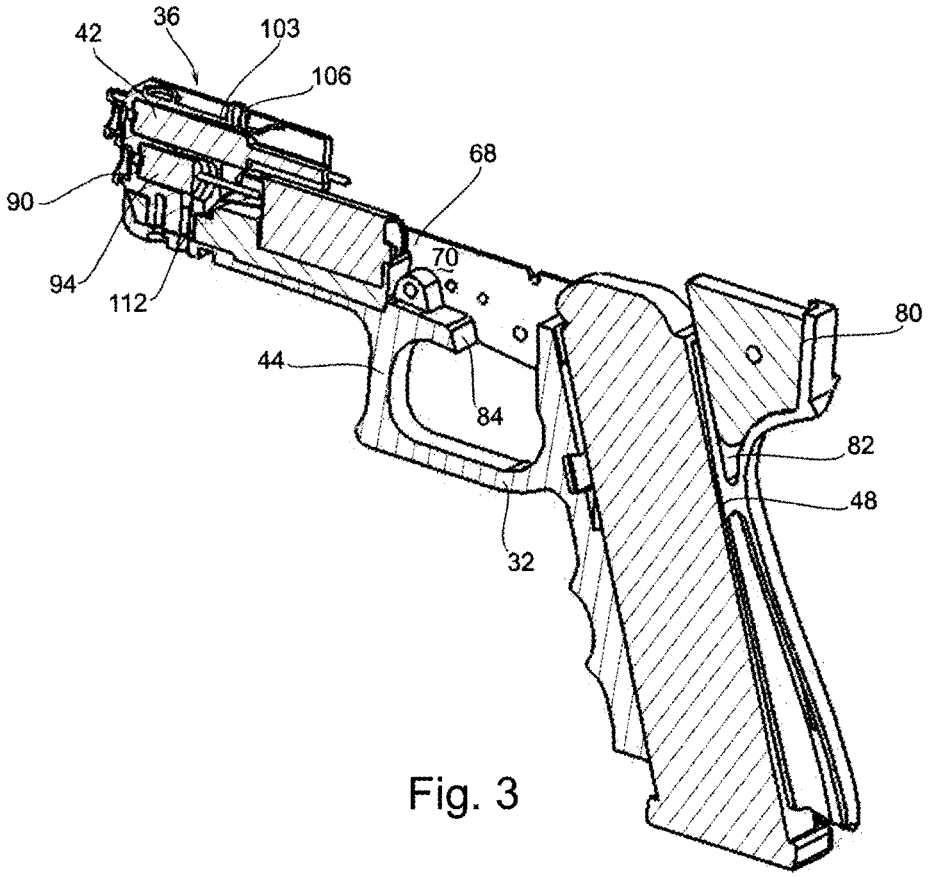
FIG. 3 shows a partial sectional view of the laser module mounted to the grip module.

As shown in FIG. 2, the grip module 32 generally comprises the grip portion 40 and an upper frame portion 42. Between the upper frame portion 42 and the grip portion is a trigger guard 44. The grip portion generally further comprises a magazine well 46 having a perimeter edge defining an open access to a magazine cavity 48 as shown in FIG. 3. FIG. 3 shows a sectional view of the grip module 32 and the laser module 36. As further shown in FIG. 3, there is a cross-section of a practice magazine (or in the broader scope, a real magazine) that is configured to fit within the magazine cavity 48.

Referring back to FIG. 2, a magazine catch 50 is provided that is configured to reposition in the lateral direction to release the magazine contained in the training pistol 20. The magazine catch can in one form be of a conventional design, which is configured to fit with a real firearm, e.g. a Glock, as well as other firearms such as, but not limited to, Sig Sauer, Springfield, Smith & Wesson, STI, SV, Beretta, CZ, etc. As shown in the various Figs., the grip module 32 is configured to have similar functional features to a Glock, in particular a Glock 17/22/34/35. Of course, in the broader scope, the functional grip features can alter or further provide generic grip features to simulate a variety of guns. The grip otherwise may be nondescript of any features and not intended to simulate any particular firearm.

As further shown in FIG. 2, the upper frame portion 42 has a rail mount region 54 that in one form is conventional and is a Picatinny rail for attachments to be attached thereto. The upper frame portion 42 further comprises first and second attachment locations 60 and 62, which in general are positioned in a longitudinally forward and rearward region. In one form, the first and second attachment locations are openings configured to have a crosspin fit therethrough to attach the slide module 38. In one form, the first attachment location comprises tang members 64 and 66 that extend vertically upwardly.

Figure 5:
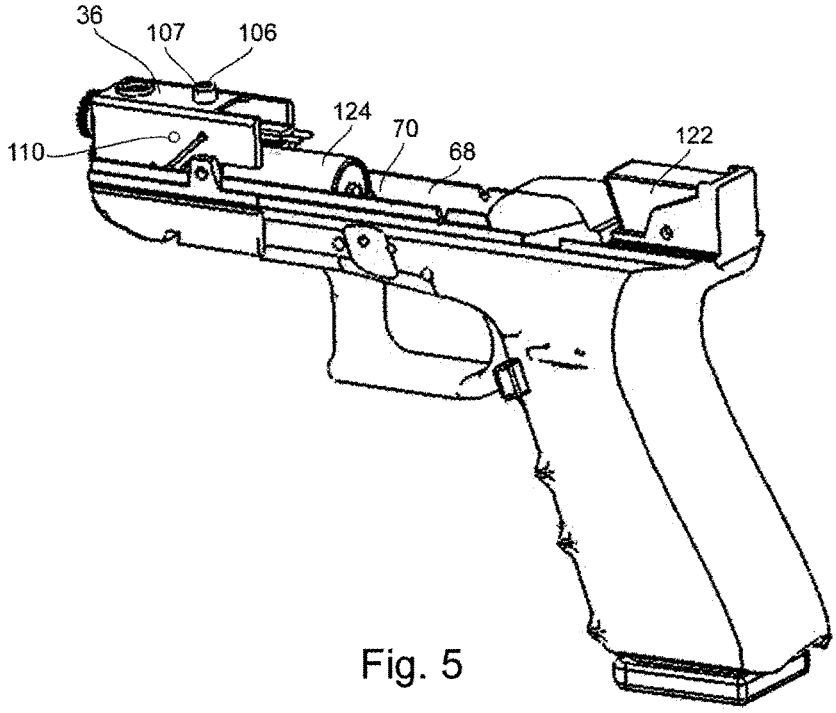
FIG. 5 shows an isometric view of the grip module with the trigger module and slide module removed and not shown.
Figure 6:
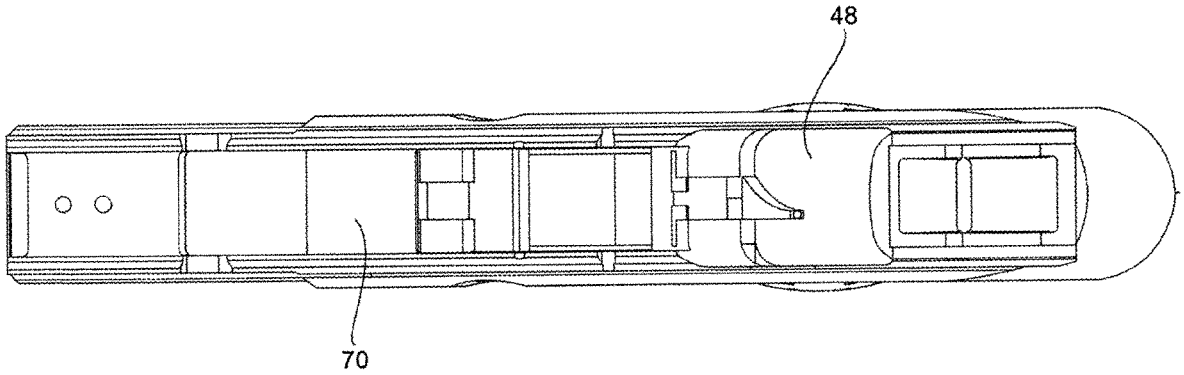
FIG. 6 shows a top view of the grip module.

As shown in FIG. 3, the grip module 32 is provided with an interior surface 68 that provides a central channel 70 as shown in FIG. 5. In general, the central channel 70 is configured to house the laser module 36 and further the trigger module 34 (see FIG. 2). As further shown in FIG. 3, there is a longitudinally rearward surface 80 that forms a rear cavity 82. The rear cavity 82 and a forward portion of the central chamber 70 are configured to house weighted inserts described further herein below. As further shown in FIG. 3 there is a trigger opening 84 that has forward and rearward surfaces to allow the trigger member 162 of the trigger module 34 to extend therein. In general, the trigger member 162 is housed therein the trigger guard 44 which is common in many firearms.

Referring now back to FIG. 2 there will be a detailed discussion of one form of a laser module 36. In general, the laser module 36 comprises a base housing 90. The base housing 90 is configured to house a laser or two lasers therein. In the broader scope, the base housing fits a shot indicator 92, which in a preferred form is a laser. Further, the laser housing 36 houses a take-up indicator 94. In one form, the take up indicator 94 is a second laser. In the broader scope, the take up indicator can be of a variety of forms such as an illuminating device, in general, a noisemaker, a vibrator, or otherwise some form of indicator such as an RF transmitter sending a signal to an RF receiver indicating that the trigger is taken up. In general, trigger take-up means that the trigger member 162 is partially pressed. In one form, take-up includes partial pressure to reposition the trigger to a set point such as where a seer or simulated seer is engaged. In other words, there is a distinct change in the amount of force required to move the trigger an additional degree such as, a change in slope of the force v. distance curve of the trigger pull. In one form, the take up indicator 94 has a red laser where the lens caps 98 and 100 can be positioned on the front portion of the base housing 90 so as to provide different optical effects described below. One optical effect to have the laser cap 98 provide illumination in a lateral direction (as opposed to a longitudinal forward direction toward the target) so the laser operates similar to an illuminating LED. This lateral illumination could be observed by a trainer or other individual or system to indicate whether the trainee is taking up the trigger at a proper time.

As further shown in FIG. 2 a second lens 100 can be employed that is configured to work with the shot indicating 92 that can be a laser and for example a different colored laser such as a green laser. The lens caps 98 and 100 are described further herein, but in general, they provide some form of altering the light passing therethrough such as to take the laser beam to make it into alternative shapes such as a circle.

As shown in FIG. 3 the laser module 36 is shown in a cross-sectional view positioned within the central channel 770. The shot indicator 92 generally has a base body that in one form is substantially cylindrical having a sufficiently hardened exterior surface so a biasing member such as a set screw can impart a positional force thereupon. There will now be a description of the shot indicating adjustment system 105 as generally shown in FIG. 1. The shot indicating adjustment system in one form comprises a first and second biasing member, which in a preferred form is a pair of setscrews that are aligned in a substantially orthogonal manner. One preferred form of arranging the setscrews is to have the longitudinal axis of a first setscrew aligned in a lateral direction and the second setscrew being aligned in a vertical direction. By having the alignments of the first and second setscrews substantially orthogonal allows for windage and vertical adjustments (left to right adjustments and up-and-down adjustments).

As shown in FIG. 1, the openings 140 and 142 of the slide member 38 provide access of an adjustment member such as a hex wrench to pass therethrough. Now referring to FIG. 3, it can be seen that the base housing 90 is provided with a surface 106 that is configured to house a biasing member such as a setscrew. In general, the surface 106 can be integral and monolithic with the base housing 90 where in one form this is a plastic injection component made from a material such as acetyl. Acetyl is particularly conducive for forming female threads that are configured to engage the male threads of the setscrew (not shown).

As shown in FIG. 5, there is shown a surface defining an opening 110, which is operatively configured to house the windage adjustment set screw. Referring now back to FIG. 3, it can be seen that the surface 112 provides an opening to house a vertical alignment set screw for the take-up indicator 94 which in one form is a laser such as a red diode laser. As shown in FIG. 1, the surface defining the opening 114 provides access to surface defining the opening 116 as shown on the base housing 90 in FIG. 2. In a similar manner as described above, the surfaces defining the openings 112 and 116 can be provided with female threading or further the various threaded surfaces can have inserts, which provide the threading to engage the threads of a setscrew. Therefore, as shown in FIG. 1 the openings 140 and 142 are provided to allow access to set screws housed in the laser module for the shot indicating laser and further the opening 114 as shown in FIG. 1 provides lateral and vertical adjustment of the take-up indicating laser.

With the foregoing description in place, there will now be a detailed discussion of the longitudinally forward and rearward weights followed by a detailed description of the slide module 38.

Figure 4:
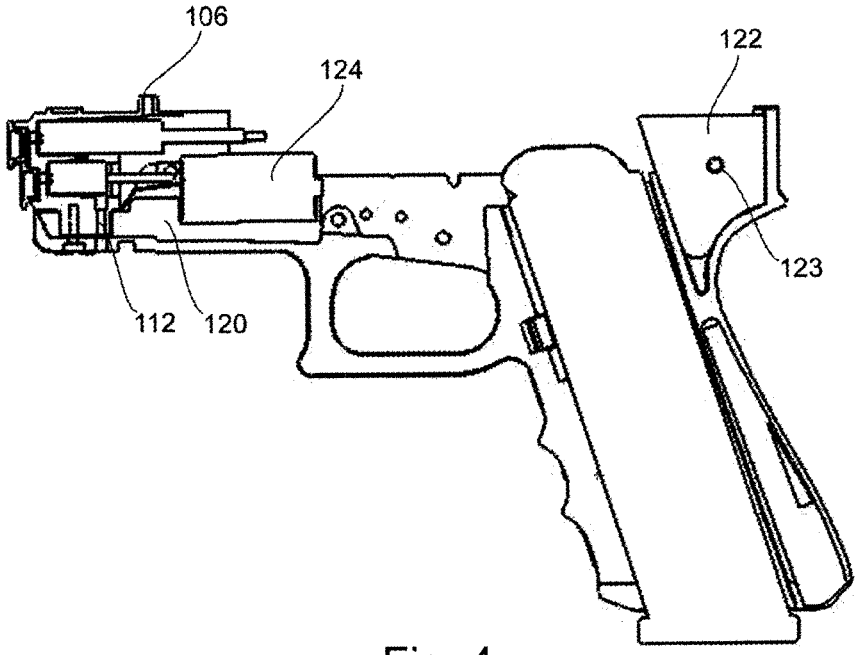

As shown in FIG. 4, there is a side cross-sectional view showing the longitudinally forward weight 120 and the longitudinally rearward weight 122. In general the weights 120 and 122 can add additional mass to the upper portion of the training pistol. In one form the weights can be comprised of a metallic material or made from a molded lead alloy with a coating therearound. As further shown in FIG. 4 the power source 124 can be provided which in one form is a replaceable battery or a rechargeable battery.

Figure 7:
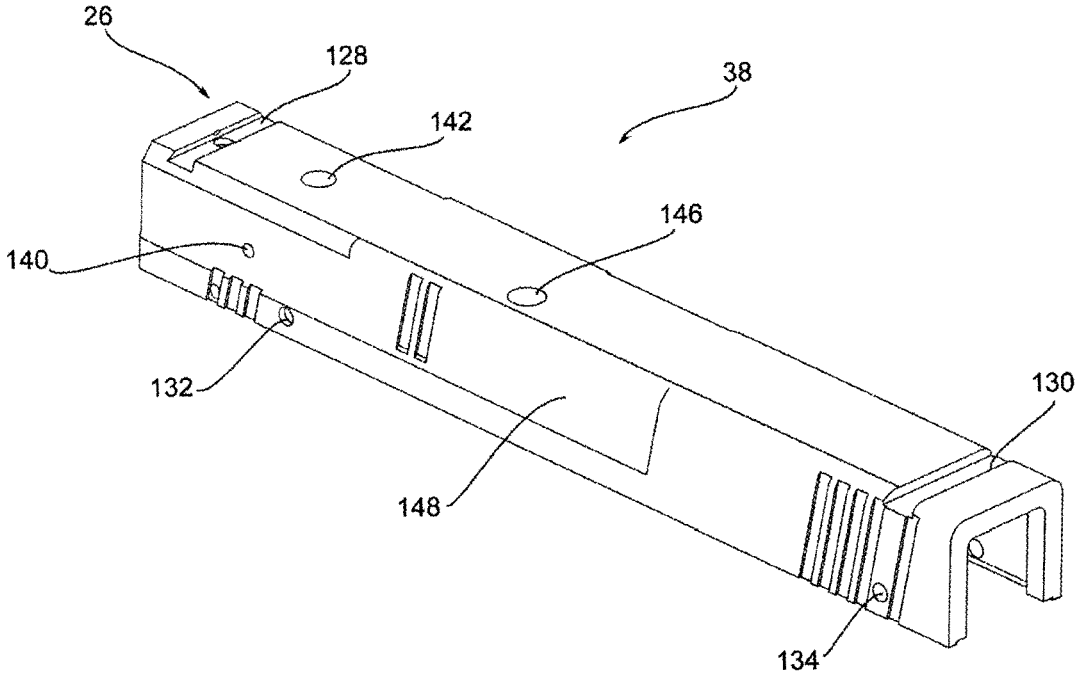
FIG. 7 shows an isometric view of one form of a slide module.

Referring ahead now to FIG. 7 there is shown the slide module 38. In general, as mentioned above the slide module 38 is provided with a sight location 26, which in general has a longitudinally forward sight region 128 and a longitudinally rearward sight region 130. Normally, a front sight would be mounted to the longitudinally forward sight region 128 and a rear sight will be mounted to the longitudinally rear sight region 130. Of course, in the broader scope, the sight location 26 can provide other sighting systems as mentioned above such as a red dot parallax free scope or other possible technologies.

The slide module 38 in one form has mounting regions 132 and 134. The mountain region 134 is a forward mounting region, which in one form comprises a surface defining an opening so a connection pin can pass therethrough. The connection pin is operatively configured to further pass through the first and second vertical extensions 64 and 66 as shown in FIG. 2 of the grip module 32. In a similar fashion, a connection pin is configured to pass through the rearward mounting region 134 as shown in FIG. 7, and the pin is further configured to pass through the second attachment location 62 of the grip module 32. It should be further noted that this pin could further pass through the opening 123 as shown in FIG. 4 to secure the longitudinally rearward weight 122 therein. In one form, a rubber grommet-like member can be positioned within the longitudinally rearward weight 122 so the pin will not mark or otherwise engage the metal of the longitudinally rearward weight that could, for example, be lead. For example, even if the lead has a coating therearound, it would be desirable to limit any possible exposure to the lead alloy comprising the longitudinally rearward weight 122. Referring back to FIG. 7, the openings 140 and 142 are provided to allow access of the setscrews of the laser module as described above with reference to FIG. 5. In one form, as shown in FIG. 5, the female threaded surface 106 can be extended within a boss 107 that extends upwardly and thereby passes through the surface 142 as shown in FIG. 7.

Figure 8:
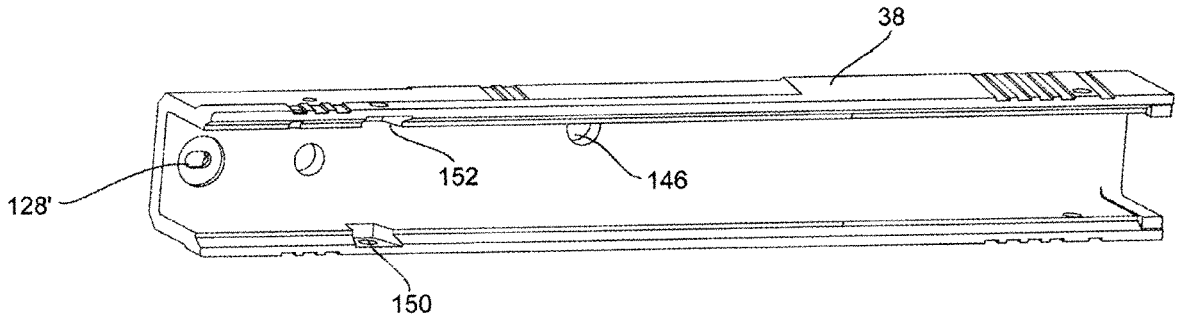
FIG. 8 shows an isometric view of the slide module showing one form of a lower interior cavity region.

As shown in FIG. 8, the longitudinally forward sight region 128' in one form can have an interior cavity region which can be an indentation configured to house a small fastener such as a hexagonical screw therein to mount a sight. In one form the slide can mount a certain type of sight such as, for example, a Springfield XD system or a front sight such as for a Glock. More specifically, in one form the upper wall thickness of the slide member can be 0.150 inches. Therefore, the interior cavity region 128' can be 0.05 inches to simulate the thickness of a Glock for purposes of mounting a sight. As further shown in FIGS. 7 and 8 there is an opening 146, which is configured to allow a switch mechanism to extend therethrough the trigger module 24 described further herein.

As shown in FIG. 7, the lateral exterior surface 148 can have various ornamental cuts thereon. In one form, the slide module is configured in a manner to be die cast molded out of a metal material, but of course other manufacturing methods can be employed such as, but not limited to, laser centering, milling, stamping, etc. As further shown in FIG. 8, the lateral recess regions 150 and 152 can be configured to receive the first and second extensions 64 and 66 as shown in FIG. 2. In one form, the tolerances can be adjusted so the load imparted upon the slide module 38 will first be applied to the extensions 64 and 66 prior to the pin passing therethrough. In one form, the laser module 36, as shown in FIG. 2, can be slightly sprung upwardly by having, for example, a rubber material interposed between the longitudinally forward weight 120 and the lower portion of the laser module 36 so when the slide module 38 is attached to the grip module 32 there is a slight compression force with the laser module interposed therebetween.

Figure 9:
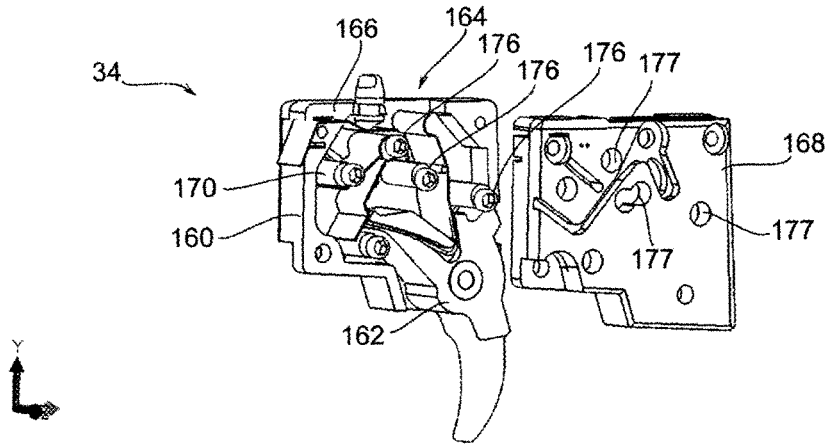
FIG. 9 shows one form of a trigger module with a split housing where the left half of the housing member is separated therefrom.

With the foregoing detailed description in place, there will now be a discussion of the trigger module with reference to FIG. 9.

As shown in FIG. 9, there is a trigger module 34. In general, as shown in the exploded view of FIG. 2, the trigger module 34 is configured to be nested within the central channel 70 of the grip module 32. In general, the trigger module comprises a housing 160, a trigger member 162 and a trigger adjustment system 164.

In general, the housing 160 can in one form comprise first and second housing members 166 and 168. In one form these members can be produced in a manner to facilitate plastic injection molding and be meshed together to form a complete housing 160.

Figure 9A:
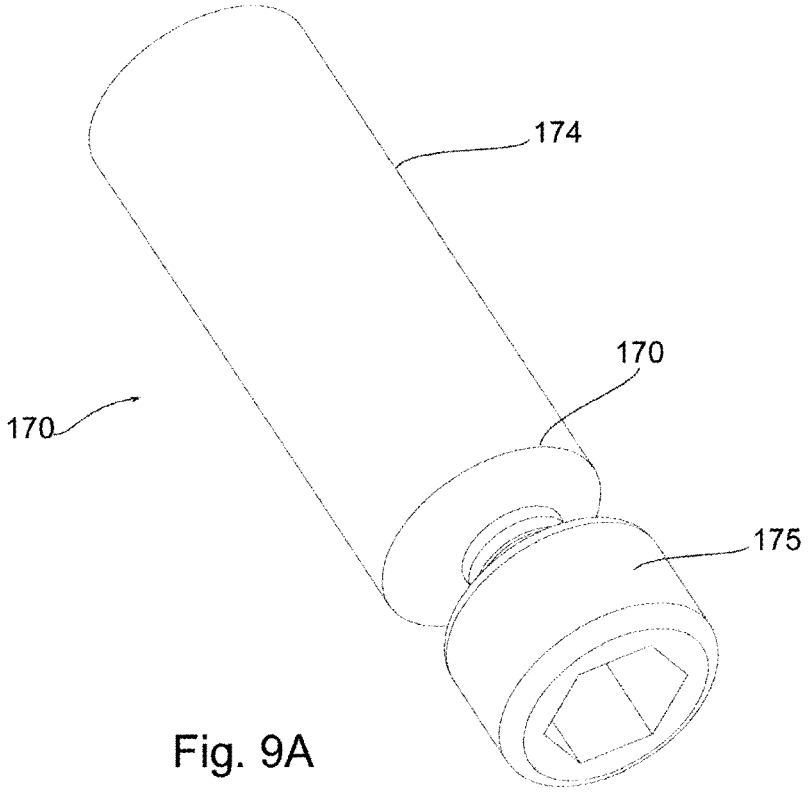
FIG. 9A shows one form of an adjustable cam member.
Figure 9B:
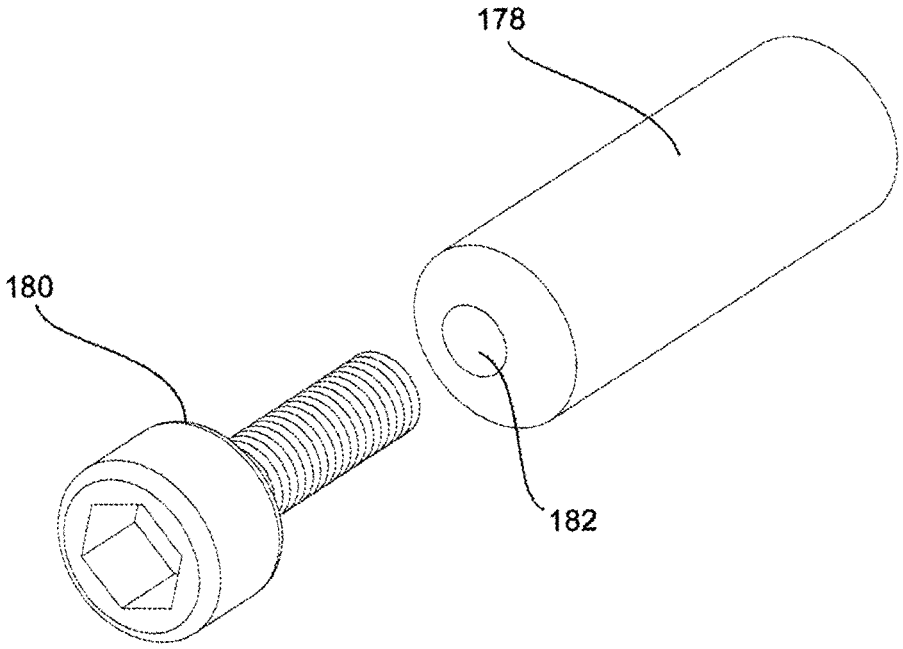
FIG. 9B shows an adjustable cam member with a cap screw.
Figure 10:
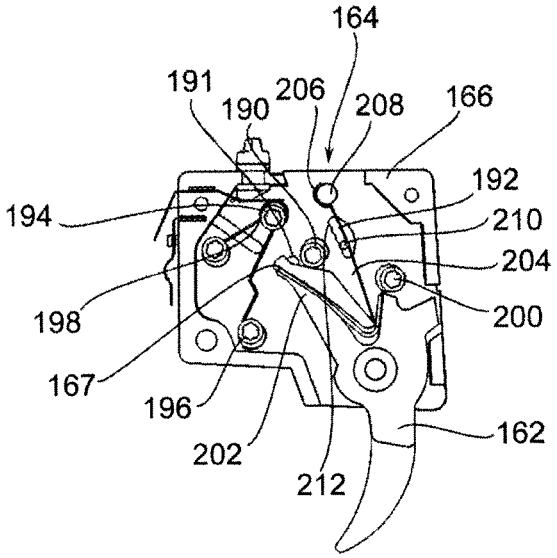
FIG. 10 shows a side view of one form of a trigger module where the trigger is in a resting forward position.

As shown in FIG. 10, there is a portion of the trigger module 34 shown where in this form the second housing member 168 of FIG. 9 is removed to show the internal components. In general, the trigger member 162 is in a first position or otherwise defined as an initial position location. The trigger adjustment system 164 can be in a variety of forms, but in one form, there are six elements of adjustment, one method of allowing the multiple adjustments to utilize a cam member. As shown in FIG. 9A, the cam member 170 has a center axis of rotation 172, which is not concentric with the outer surface 174. The adjustment head 176 in one form is fixedly attached to the base body 178. As shown in FIG. 9B, the locking member 180 in one form can be a cap screw, which can be similar to the adjustment head 176, except the adjustment head would be fixedly attached to the base body 178. In general, the locking member 180 would be operatively configured to be fit within the surface defining the opening 182, which in one form is a female threaded surface. In general, the annular shoulder 184 of a locking member 180 is configured to engage the rearward surface of the first housing member 164 (which would be on the backside of FIG. 10). Therefore, it can be appreciated that the outer surface 174 of the base body 178 is configured to engage various components to adjust positions thereof.

Now referring back to FIG. 10, it can be appreciated that the trigger adjustment system 164 generally comprises an initial position adjustment member 190, a take-up force adjustment member 192, a seer engagement location adjustment member 194, a degree of seer engagement adjustment member 196, a seer force adjustment member 198 and finally an over travel adjustment member 200. Of course, in the broader scope, the adjustment members can be in other forms such as setscrews extending in the plane defined by the lateral axis or a lesser amount of adjustment features can be employed. At any rate, one form of a trigger adjustment system 164 will be described showing various phases along a trigger pull also showing a few examples of adjustments that can be made.

FIG. 10 shows the five cam members of the various adjustment members in a fixed position with respect to the first housing member 166. The trigger member 162 is in the first position and the take-up force adjustment member 192 is biasing the trigger in a clockwise direction, whereby the trigger extension 202 is biased there against the initial position adjustment member 190. As shown in FIG. 9, the various adjustment heads 176 of the cam members are configured to extend through the openings 177 of the second housing member 168. On the opposing side of the first housing member 166 there are smaller holes just large enough for the shaft portion of the locking member 180, as shown in FIG. 9B, to extend therethrough whereby when a locking member 180 is fastened down, the various, cam members 170 are locked in place with respect to the first housing member 166. To reiterate this operation, as shown in FIG. 9B the locking member 180, which can be a cap screw, can be loosened with respect to the base body 178, and on the opposing side of each cam, the adjustment head 176 as, for example, shown in FIG. 9, can be rotated a desired amount for adjustment. When the cams are in a desired position the cap screw/locking member 180 on the opposing side of the respective cam can be fastened down (not shown in FIG. 9).

FIG. 10 shows the initial position adjustment member 190 in a particular orientation allowing the trigger member to be in a longitudinally forward most location. In one form, an additional opening 191 can be provided to reposition the cam member of the initial position adjustment member 190 to provide a wider range of adjustment for the initial positioning of the trigger member 162.

As noted above, the take-up force adjustment member 192 in one form is a leaf-like spring 204, which can have a concave portion 206 that is configured to engage the pin 208. The adjustment pin 210 can provide a moving fulcrum point where the adjustment slot 212 is provided with a plurality of indentations to nest the adjustment pin 210. In other words, when the adjustment pin 210 is positioned downwardly in FIG. 10, there is a greater amount of force effectively applied to the trigger member 162.

Figure 11:
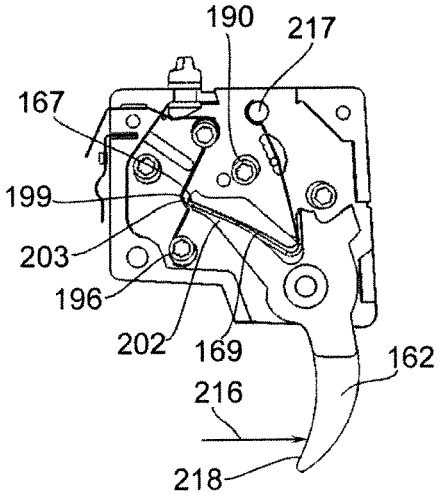
FIG. 11 shows the trigger rotation advanced where the trigger extension is engaging the seer member and in one embodiment closing the circuit for activating the take-up indicator which can be a first laser such as a red laser.
Figure 12:
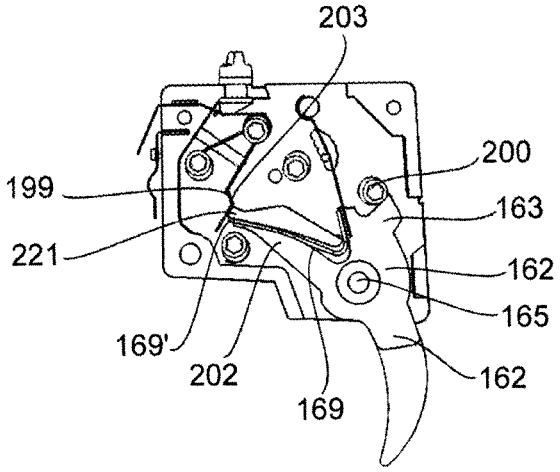
FIG. 12 shows the trigger in a "post-break" state where the trigger is passed beyond the seer member and the over travel cam is engaging the trigger where in one form the over travel cam closes the circuit for the second laser such as a green shot indicating laser.

Now referring to FIG. 11, it can be seen that the trigger member 162 has a force indicated by vector 216 imparted thereon at a finger engagement location 218. It can be seen that the internal trigger extension 202 has repositioned counterclockwise and has disengaged from the initial position adjustment member 190. The trigger extension 202 has engaged the seer member 199. In general, the degree of seer engagement and adjustment member 196 can be a cam member similar to that as shown in FIGS. 9A and 9B. The position of this cam can adjust the amount of seer engagement between the seer member 199 and the trigger extension 202. Now referring to. FIG. 12, it can be seen that the trigger has been "broken" whereby the trigger extension 202 has passed by the seer member 199. The over travel adjustment member 200 thereby engages the trigger member 162 in one form, a tail 163 is provided that extends from the center of rotation 165 of the trigger member 162. The tail is configured to engage the over travel adjustment member 202 to stop the clockwise rotation of the trigger member 162. It can be seen in FIG. 12 that the trigger extension 202 has passed a certain rotational amount past the seer 199 and more specifically the seer engagement surface 203.

The seer engagement surface 203 is configured to engage the trigger extension member and more specifically the trigger seer 167 as shown in FIG. 11. In one form, the trigger seer is partially comprised of a conductive element such as a conductive wire 169 so the trigger seer 167 when engaging the seer engagement surface 203 operates as a switch activating the trigger take-up system described further herein below.

Figure 13:
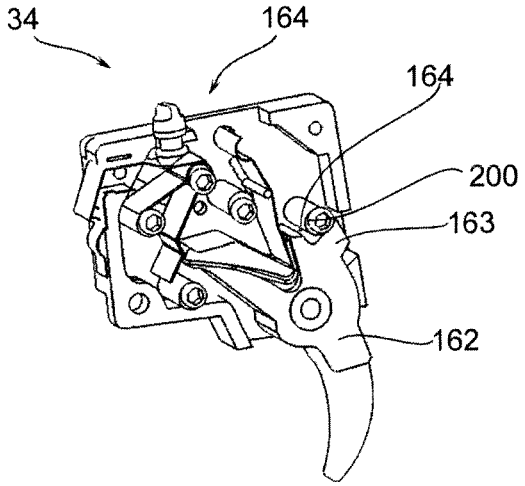
FIG. 13 shows an isometric view of the trigger module without the left housing member attached thereto.
Figure 14:
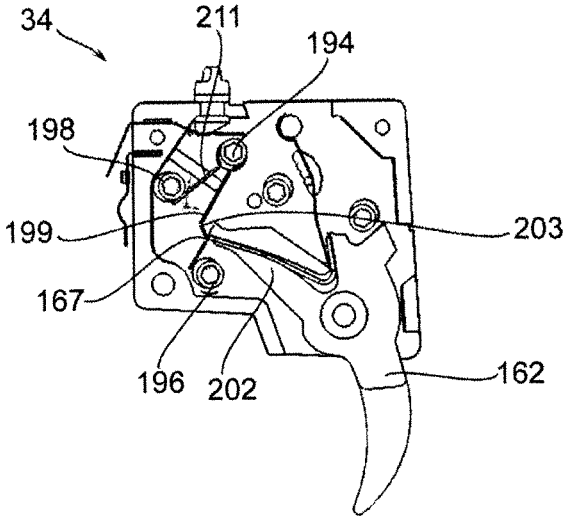
FIG. 14 shows another view of the trigger module where the cams are in a slightly different orientation.
Figure 15:
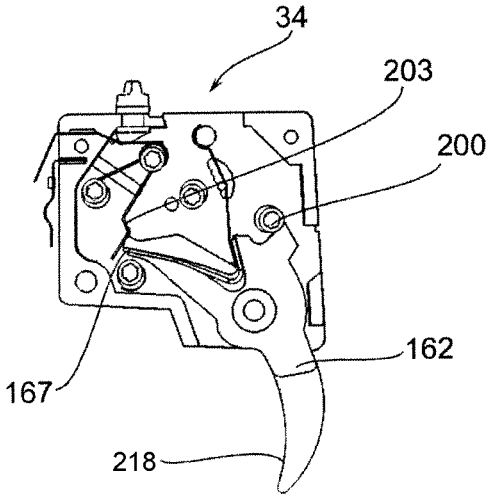
FIG. 15 shows the trigger module where the cam adjustment members are arranged in a different orientation.
Figure 16:
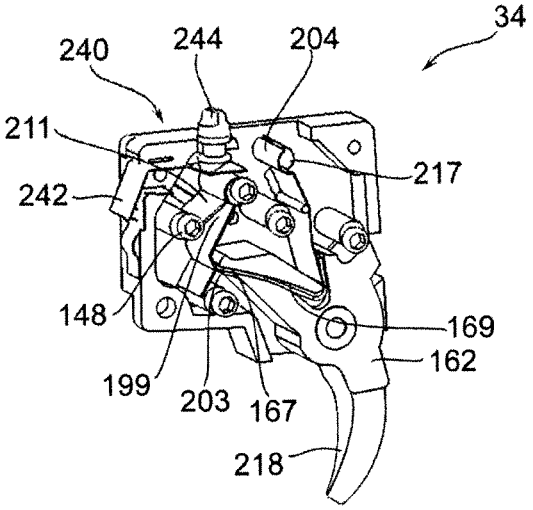
FIG. 16 shows an isometric view of the trigger module without the left housing.

Now referring to FIG. 13 there is an isometric view of the state of the trigger assembly 34 as shown in FIG. 12. The trigger member 162 is in a second position or otherwise referred to as a fully depressed position. The over travel adjustment member 200 can be adjusted to modify the degree of rotation of the trigger member 162. In general, given the multitude of adjustments of the trigger adjustment system 164, in one form the second housing member 168, as shown in FIG. 9, can be made of a transparent material such as, for example, nylon 611. The various adjustment cams do not adjust the properties in isolation. For example, now referring to FIG. 14, there is shown the trigger module 34 in a different adjustment state. In this form, the degree of seer engagement adjustment member 196 is positioned in a manner to reposition the seer member 199 so the seer engagement surface 203 is positioned further away and has less overall surface area engaging the trigger seer 167. Further, it can be appreciated that the seer engagement location adjustment member 194 is configured so as to position the seer engagement surface 203 in a further lower position. Therefore, as shown in FIG. 14, the trigger member 162 must be repositioned further rearwardly before there is, engagement between the seer engagement surface 203 and the trigger seer 167. It should further be noted that the seer force adjustment member 198 can be adjusted in a plurality of forms. In one form the seer member 199 is a unitary and monolithic structure formed out of a thin piece of metal for example between 0.003 inches-0.012 inches, and the spring extension 211 can provide a biasing force upon the seer engagement surface to be biased more forcefully toward the trigger extension 202. As shown in FIG. 15, the trigger module 34 is in an advanced state where the trigger member 162 has been sufficiently repositioned longitudinally rearwardly at the finger engagement location 218 to "break the trigger." It is clear that trigger has been broken and fully depressed because the trigger seer 167 is now past the seer engagement surface 203. It can be shown in FIG. 15 that the over travel adjustment member 200 has been properly adjusted to engage the trigger member 162 to allow a prescribed amount of over travel. Referring now to FIG. 16, it can be seen in an isometric view how the spring extension 211 is engaging the seer engagement seer force adjustment member 198. It should be noted that the orientation in FIG. 16 is similar to the orientation, as shown in FIG. 14, where the trigger member 162 is "taken up" which means it is engaging the seer surface. In general, there is a certain amount of initial travel or "play" in a trigger for most firearms. The trigger module 34 allows for adjustment of this play and the take-up force so the trainee can properly train taking up the trigger. As far as the trainee shooter is concerned, there is a distinct change in the force v. distance profile of rotation of the trigger member 162 where when the trigger seer 167 engages the seer engagement surface 203, an increase in rate of force is required to continue to reposition the finger engagement portion 218 longitudinally rearwardly. As described further herein, this critical stage of a trigger pull can be monitored by the trigger take-up system which in one form is a laser such as a red laser described further herein.

Insert above after discussion of FIG. 16.

Figure 16A:
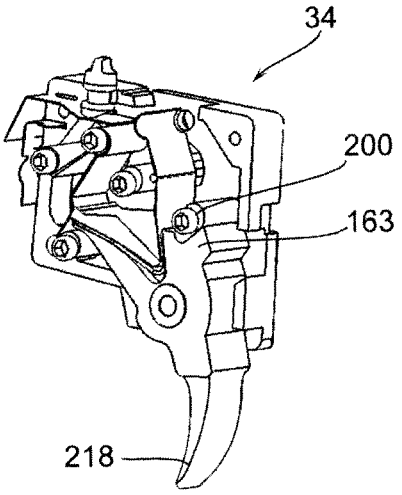
FIG. 16A shows an isometric view of a rearward portion of the left trigger module showing one form of a trigger take-up spring.

As shown in FIG. 16A, there is an isometric longitudinally rearward view of a portion of the trigger module 34 in the fully depressed state. In this Fig. it can be seen that the finger engagement portion 218 is fully pressed rearwardly wherein one form the tail 163 is now in engagement with the over travel adjustment member 200.

With the foregoing, description in place the trigger module 34, there will now be a discussion of how the trigger module in one form can operate as an integrated switching system to operate the take-up indicator 94 and the shot indicator 92 (see FIG. 2). in one form of a switch system, electric current can pass there through the trigger member 162 as shown in FIG. 16. In one form, the conductive wire 169 can receive electric current from the power source 124 (see FIG. 5). In one form, as shown in FIG. 11 the pin 217, for example, can have a positive or negative lead attached thereto. As shown in FIG. 16, in one form the electric current can pass through the leaf-like spring 204 to allow the current to pass through the conductive wire member 169. As shown in, for example, FIG. 16, as soon as the trigger seer 167 and more specifically the forward portion of the conductive wire 169 forming a portion of the trigger seer 167, engages the seer engagement surface 203, current is allowed to pass there between. In one form, the take-up indicator switch 240 is provided where the conductor 242 is an electrical communication with the take-up indicator 94 (FIG. 2). As further shown in FIG. 16, a switch member 244 can bias the inward portion of the electric conductor 242 against the seer member 199. When it is desired by the shooter to turn off the operation of the take-up indicator, the switch member 244 can be repositioned so the conductive member 242 is no longer in engagement with the seer member 199. In other words, for certain training situations the target area can be too visually "busy" having a red laser showing take-up and a green laser thereafter showing the breaking shot. (Of course, the color arrangement is only one form of a visual display.) Therefore, as shown in FIG. 1, the switch member 244 protruding through an opening of the slide member 38 can be in one form rotated to turn off the take-up indicator irrespective of the trigger position.

Referring now to FIG. 13, it can be shown where the trigger member is in a state of being completely depressed and in this form a portion of the conductive wire 169 extends around the right-hand side of the trigger member 162 and further extends upwardly towards the tail 163. Therefore, this portion of the conductive wire 169 carries current therethrough and when this wire is in engagement with the metallic or otherwise electrically conductive cam member of the over travel adjustment member 200 a second circuit is closed and the shot indicator is activated. In other words the over travel adjustment member can be an electrical communication with a lead to the laser, which is the shot indicator 92 as shown in FIG. 2, in one form the housing of the trigger module can be excavated out or otherwise provide a canal region for an electrical conductor such as a wire passed there through to the shot indicator 92 which in one form is a green laser. The other lead to the laser can be attached to the opposing electrical polarity of the power system. In other words, if the positive leads of the take-up laser and overture and shot laser are connected respectively to the seer member 199 and the over travel adjustment member 200 respectively, then the negative leads of the lasers can be directly attached to the negative pole of the power supply.

Of course, there is a plurality of ways of providing an adjustment system whereby an optical switch, for example, can be utilized. Further, the trigger member 162 can be made out of a metallic material and current could, for example, be passed directly to the trigger by the trigger pin, which pivotally mounts the trigger to the trigger module housing. It should further be noted that when the trigger "breaks", there is an electrical miscommunication to the trigger take-up indicator. As shown in, for example, FIG. 12, it can be seen how the electrically conductive member 169 is not in communication with the seer member 199. More specifically, if the trigger member 162 is made from a non-conductive material such as, for example, plastic, the insulator tip 221 is positioned longitudinally forwardly of the forward portion 169' of the electric conductor 169. Therefore, as soon as the trigger is broken, the take-up indicator will shut off and the over travel indicator will activate which in one form flashes from a red laser to a green laser (or vice versa).

Figure 17A:
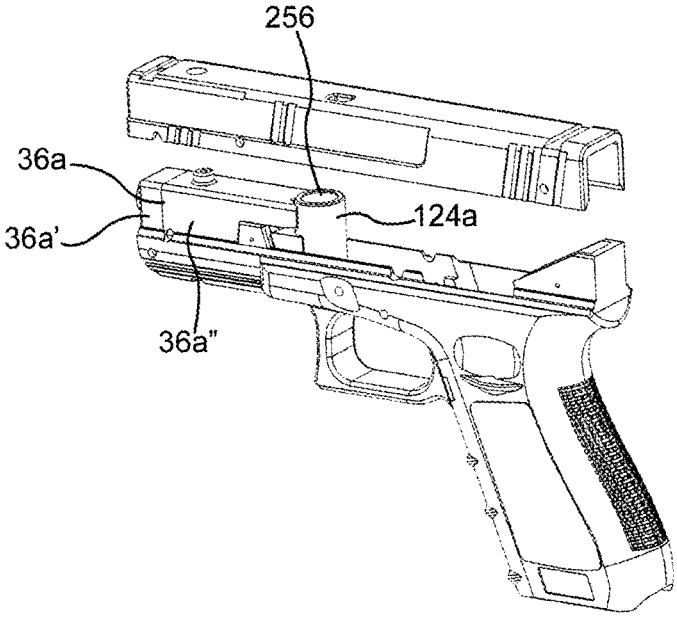
FIG. 17A shows a partially exploded view of another orientation of the training pistol.
Figure 17B:
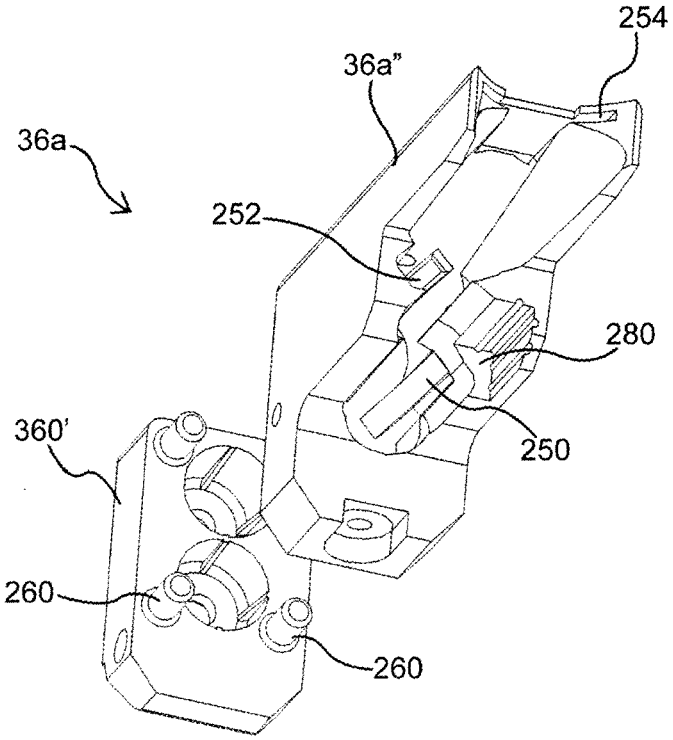
FIG. 17B shows an exploded view of another form of a laser housing.
Figure 17C:
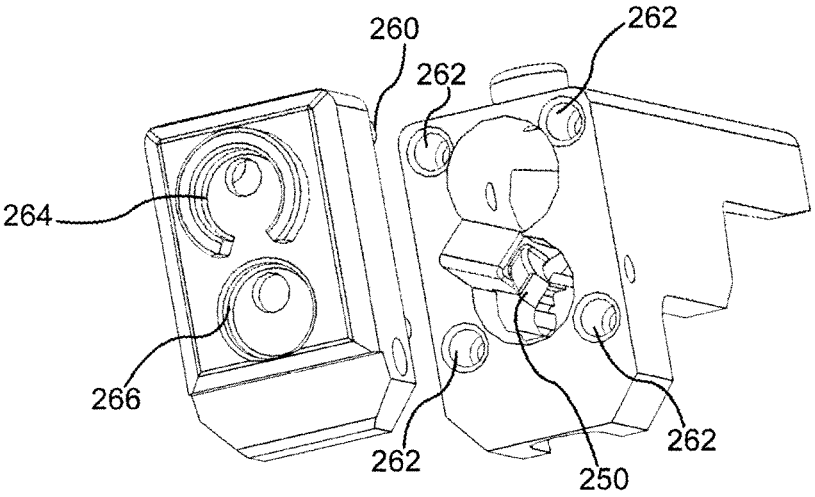
FIG. 17C shows a front view of the laser housing.
Figure 18:
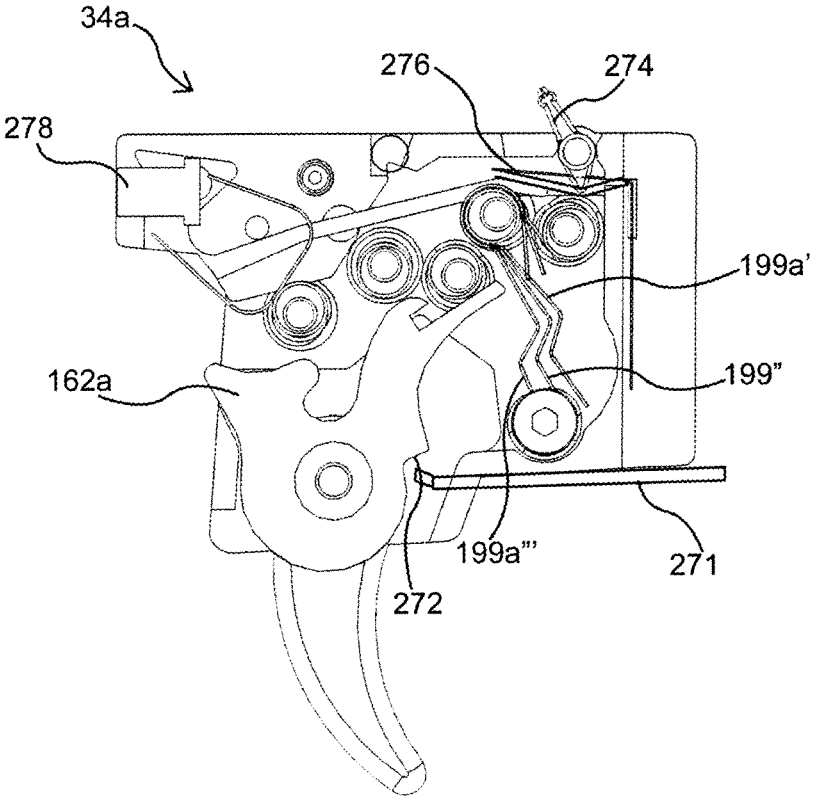
FIG. 18 shows a side view showing one form of a trigger module.

As shown in FIG. 17A, there is another orientation where the laser module 36*a* is shown. In general, the laser module 36*a* is comprised of a front piece 36*a*' and a longitudinally rearward piece 36*a*". The power source 124*a* can again, in one form, be a battery, such as a 123-lithium battery. As shown in FIG. 17B, there is an exploded view for the lower portion of the laser module 36*a*. In general, the rearward portion 36*a*" can be made with an injection mold process, in one form having a two-piece mold design. In general, springs are provided, which in one form can be integral with the monolithic structure of the rearward piece 36*a*". The lower laser spring 250 is configured to engage the lower laser. As shown in FIG. 17C, it can be seen that the lower laser spring 250 extends towards the center cavity where the laser is positioned. It can further be noted that the spring member has access from the vantage point in FIG. 17C to allow a first half of a plastic injection mold to pass therethrough to form the unit. Referring back to FIG. 17B, the upper laser spring 252 is shown, which is configured to engage the upper laser. In one form with present technology, the upper laser is a green laser beam larger than, in one form, a lower laser, which is a red laser, which has a smaller form factor at the time of this filing. The slot 254 is provided to fit a ground strap therein. As shown in FIG. 17A, the ground strap 256 is provided to close an electrical circuit to activate the lasers. Referring back to FIG. 17B, the pegs 260 are provided to interface with the surface defining the openings 262, as shown in FIG. 17C, to mate the pieces together. As further shown in FIG. 17C, the front portion can have a detent region 264 and 266 to provide attachment of lenses described above. FIG. 18 shows another form of a trigger module 34*a*. In this form, the trigger module comprises a trigger member 162*a*. As shown in this Fig., there are an assortment of cams, as described above, and the seer member 199*a* is shown in different positions at 199*a*', 199*a*" and 199*a*'".

The various positions of the seer show motion thereof as the trigger tongue portion of the trigger member 162*a* repositions a seer. In one form, a positive conductor 270 is provided, which is in communication with the power supply (battery) 124*a*, as shown in FIG. 17A. The positive conductor 270 is operably configured to engage the conductive portion 272 of the trigger member 162*a* to effectively charge the trigger. Therefore, when the trigger comes into contact with the seer 199*a*, current flows therethrough, and the take-up switch 274 can selectively provide electrical communication to the take-up conductor 276 to close the circuit and activate the take-up laser, which in one form is a red laser. Further, the trigger member 162*a* is configured to be fully depressed and come in contact with the over travel cam 170. The over travel cam is in electrical communication with the plug 278. Referring back to FIG. 17A, a pair of wires from the trigger module can pass along the trigger module to the forward weight, where the positive leads from the battery are in electrical communication with the lasers. In one form, an electrical communication plug can be inserted at the location 280, as shown in FIG. 17B, where the positive current transferred from the trigger module is thereby transferred to the positive leads of the lasers.

Figure 18A:
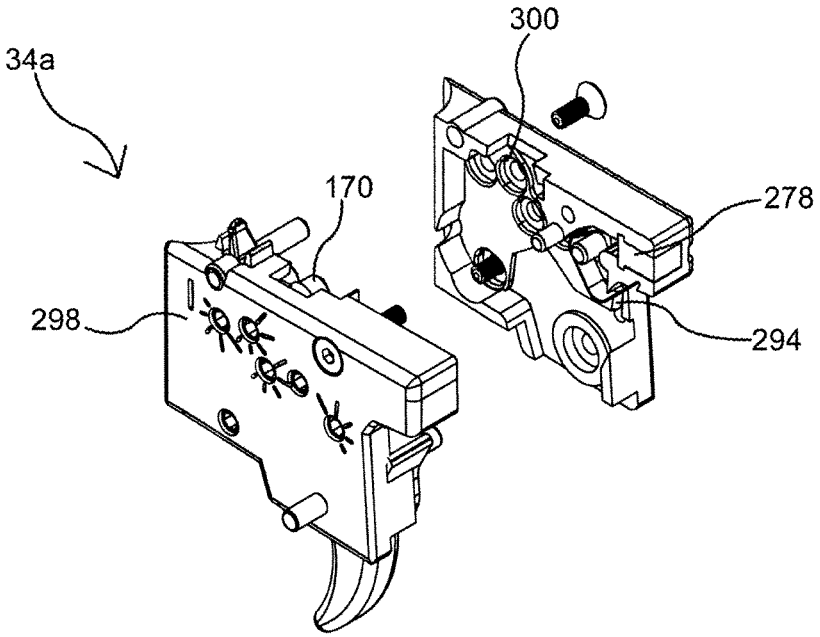
FIG. 18A shows an isometric view of one form of a trigger module in a partially isometric view with the left and right halves separated from one another.
Figure 18B:
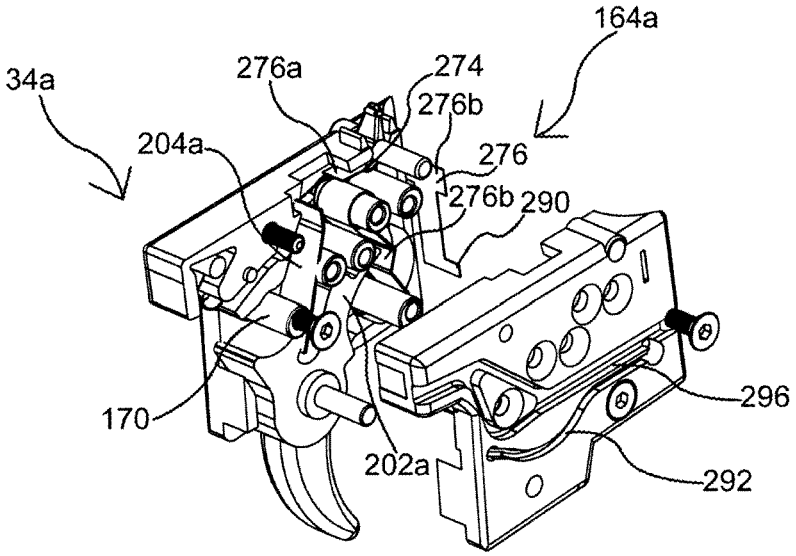
FIG. 18B shows the trigger module from the opposing side of FIG. 18B in an isometric view showing the internal cam members and trigger member.

Now referring to FIGS. 18A and 18B, there is shown a partially exploded view of the trigger modules 34*a* and there is shown the trigger adjustment system 164*a*. It should further be noted that the take-up conductor 276, in one form, has the movable contact extension 276*a* and further the base 276*b*. In one form, a wire is soldered to the lower region 290, and this wire can pass along the slot 292. Now referring specifically to FIG. 18A, the wire can pass up through the interior portion of the slot 294 and be electrically connected to the plug 278. The plug 278 in turn can have wires attached thereto, which pass forwardly through the slot 296 and pass forwardly to the laser module to complete the electric circuit based upon the position of the trigger. It can generally be seen in FIG. 18B the leaf-like spring 204*a* that is shown, in one form, to provide initial take-up force resistance, and the trigger extension 202*a* is configured to engage the seer member 199*a*. It can generally be appreciated in FIG. 18 the positive conductor 271 is configured to pass positive current to the trigger so that the trigger is effectively charged, and when the trigger extension 202*a* engages the seer 199*a*, the take-up indicator (the red laser in one form) is activated. Of course, this activation can be turned on and off depending upon the state of the take-up switch 274. In general, as noted above, the take-up switch 274 acts as a cam-like switch, as better shown in FIG. 18, to selectively turn, activate or deactivate the take-up indicator when the trigger is prepped.

As shown in FIG. 18A, the markings generally shown at 298 provide positional orientations of the cam members 170. In general, the cam members, as described in detail above in FIG. 9A, are configured to have an exterior surface nonconcentric with the center of rotation, and the recessed regions, as generally shown at 300, are provided to allow a prescribed amount of rotation of the cam members for adjustment of the trigger properties.

Figure 18C:
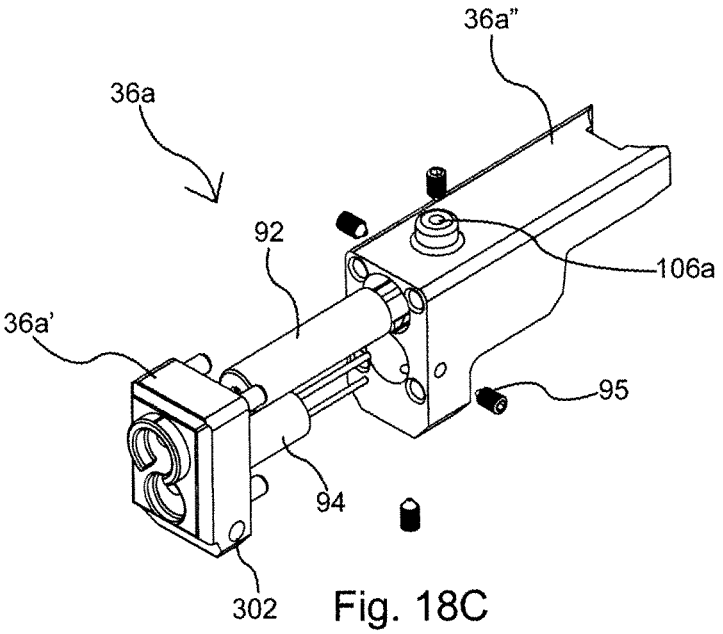
FIG. 18C shows a partially exploded view of the laser module.
Figure 18D:
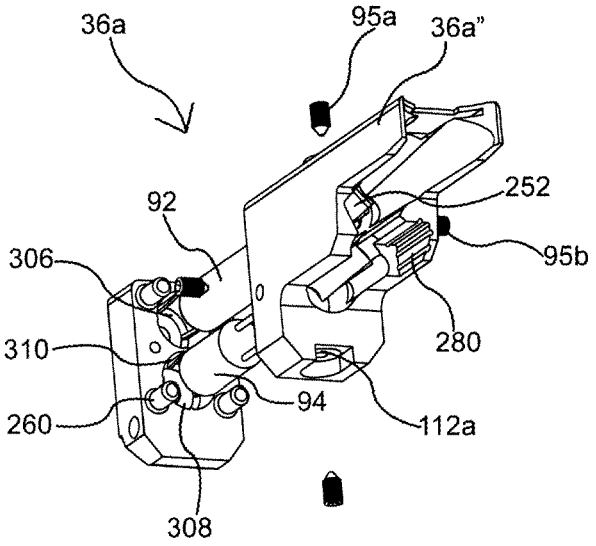
FIG. 18D shows a partially exploded view of the laser module from a rearward, lower orientation, in part showing the integral springs of the rear portion of the laser housing.
Figure 18E:
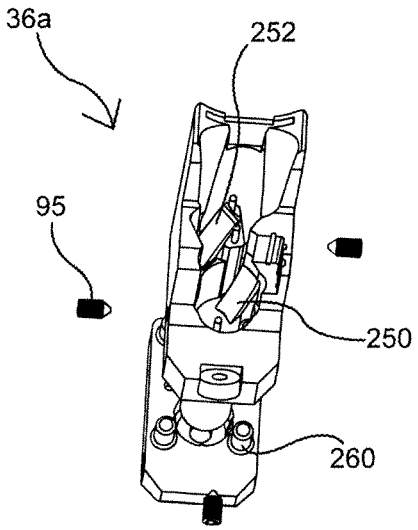
FIG. 18E shows the rearward portion of the laser housing, showing the cavities where lasers fit therein and the corresponding spring splicing the lasers toward the adjustment members.
Figure 18F:
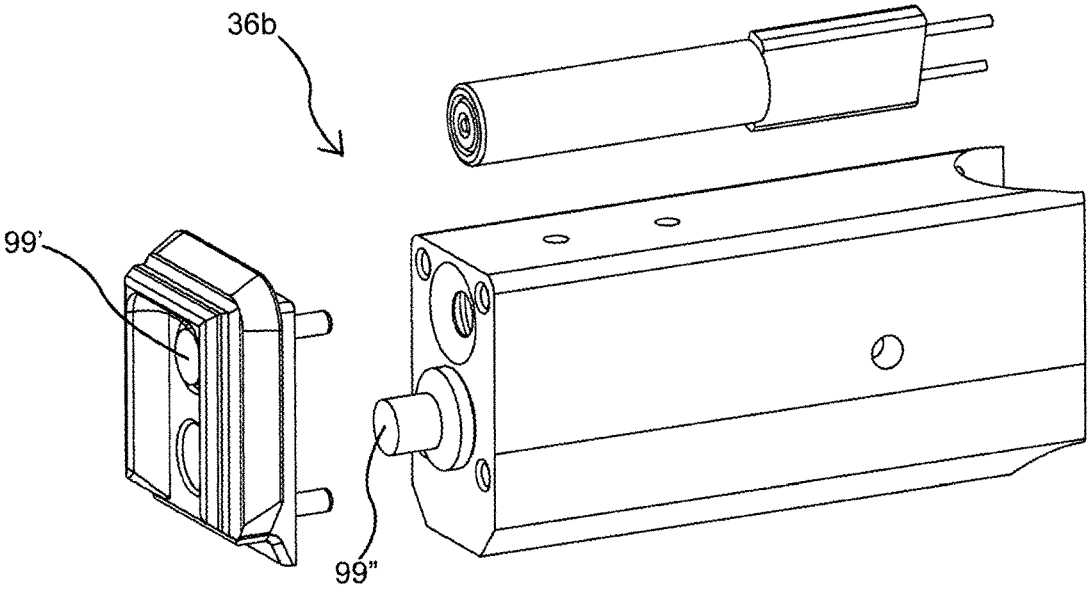
FIG. 18F is another adjustment mechanism to adjust the laser.
Figure 18G:
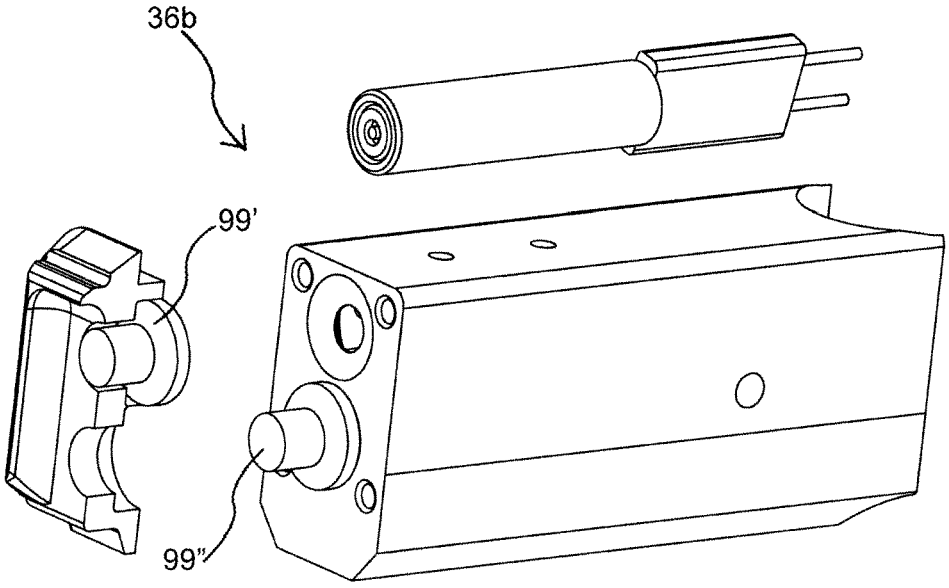
FIG. 18G is another adjustment mechanism to adjust the laser.

Now referring to FIGS. 18C-18E, there are shown several exploded views of the laser housing 36*a*. FIGS. 18C-18E show various orthogonal views of a laser module. It should generally be noted that the opening 302 is provided to have a pin passed therethrough, corresponding in location to an opening in the frame for pinning the laser module to the frame. The lasers 92 and 94 are shown and are configured to be positioned in between the front and rear components 36*a*' and 36*a*". A plurality of adjustment members are be shown, which in, preferred form are setscrews 95; this is one method of adjusting the lasers, by generally having the lasers reasonably fixedly attached at the inner cavities 306 and 308, as shown in FIG. 18D, and having the rearward portion of the lasers shifted laterally and vertically for adjustment thereof. It can generally be appreciated that, for example, the set screws 95*a* and 95*b* are configured to press and bias the laser against the upper laser spring 252, where in one preferred form the upper laser spring 252 pushes and biases the laser towards both the setscrews 95*a* and 95*b*. Referring back to the cavities 306 and 308, there can generally be seen, in one form, crush ribs 310 configured to hold the lasers in a forward location. Further, an adhesive can be used, such as silicone based adhesive the lasers in a forward position during use of the pistol and adjustment of the lasers. FIGS. 18F and 18G show another embodiment where the laser housing comprises, a lens 99' and 99" that are configured to me adjustable to reposition the laser beam from the lasers. In one form, the lenses 99' and 99" can be rotated and fixed in position to get the lasers adjusted to generally focus the beam in a proper direction.

Figure 19:
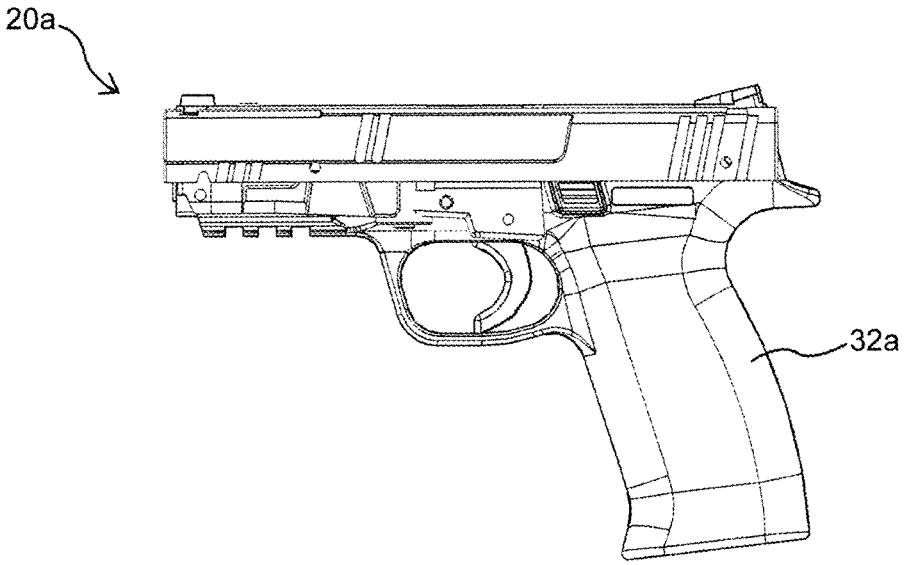
FIG. 19 shows another form of a pistol adopting functional features of other models of pistols, such as the Smith & Wesson M&P by way of an example, to provide other platforms of a pistol providing the requisite amount of functional features for proper training.

FIG. 19 shows an example of a shot indicating resetting trigger system with a training pistol 20*a*, which is shown in a different form factor. In general, the grip module 32*a* can be of a module of different forms to emulate other firearms. In one form, the grip module 32*a* can be interchangeable with other modules, such as the laser module, the trigger module, as well as the slide module, to provide interchangeability of modules to switch out for different shooting platforms. In other words, the user can have a variety of grip modules to accommodate different firearm platforms.

Figure 19A:
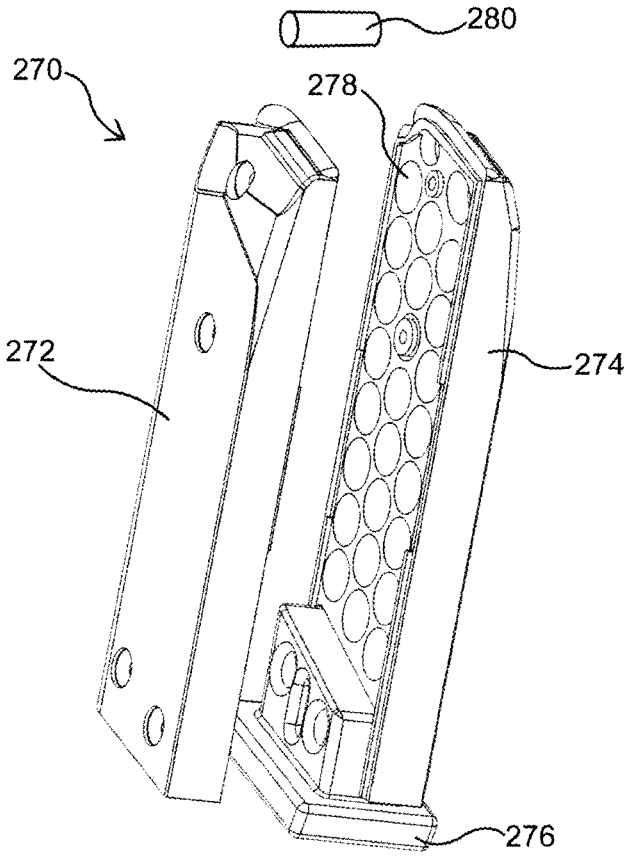
FIG. 19A shows an exploded view of a training magazine.

As shown in FIG. 19A, there is shown an accompanying weighted magazine system. In general, the practice magazine 270, in one form, comprises left and right halves 272 and 274. In one form, there is a base 276, which is interposed between the halves 272 and 274. In one form, the base is comprised of a material that is more resilient to withstand dropping on a floor. The material of the base 276 can be of a rubber-type material, that in one preferred form can be plastic injection molded. The base should have sufficient hardness to resemble to some degree grasping a real magazine, but it should also be sufficiently soft and pliable, having a low enough durometer rating so that it can be dropped on the floor without damaging the floor or the magazine. The A and B halves comprise a plurality of openings 278, which are operably configured to fit weight members 280 therein. The weight members 280 are positioned therebetween to simulate the weight of a loaded magazine. The user can adjust the amount of weight 280 to use and can also adjust the position to emulate the total weight and center of gravity of the actual load the user utilizes. For example, the total weight and center of gravity of 10 rounds of 115-grain bullets is going to be substantially different than 15 rounds of 180-grain bullets.

Figure 19B:
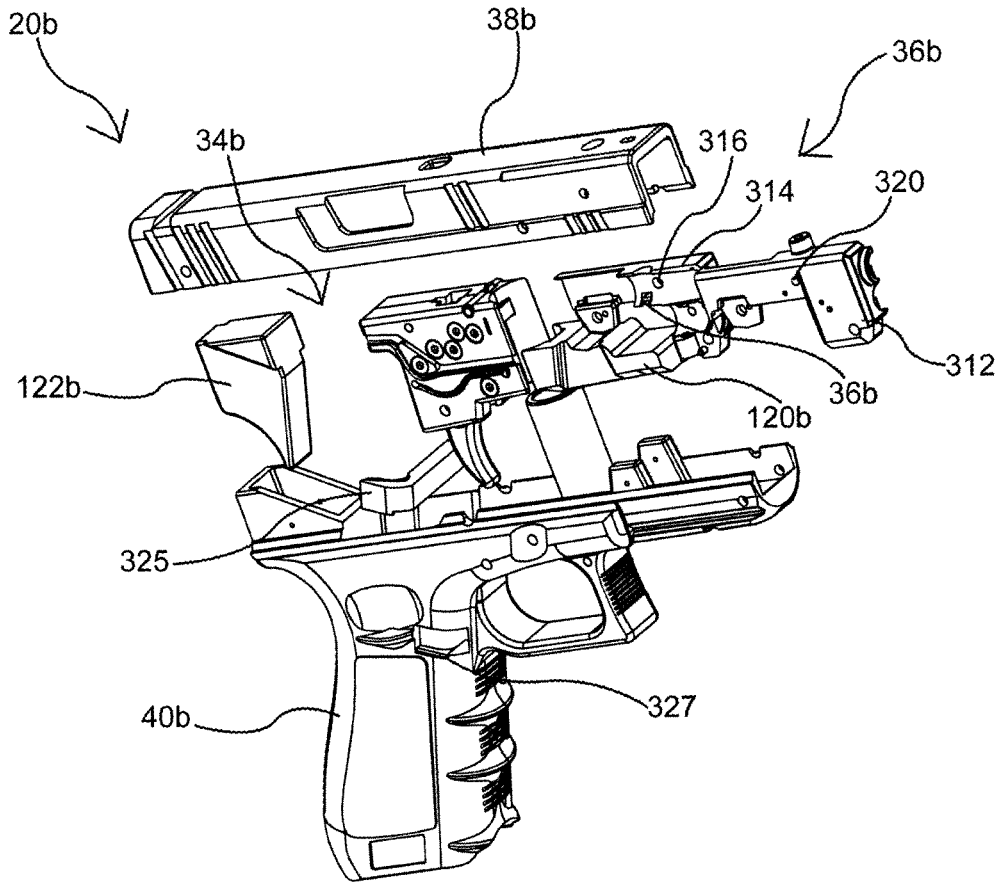
FIG. 19B shows an exploded view of another version of the pistol with yet another version of a laser module having a split half version.

Now referring to FIG. 19B, there is shown an exploded view, in one form, of the training pistol 20B. There can generally be seen similar components as to the previous embodiments, where in general there is a grip portion 40*b*, a slide module 38*b*, a rear weight 122*b*, a longitudinally forward weight 120*b*, and further, a trigger module 34*b*. FIG. 19B further shows a portion of a slightly different modified laser module 36*b*, where in this form the module has left and right sections 312 and 314. In this form, lasers can be interposed between the sections 312 and 314. For example, in one form, positioned in the slot 316 can bias a laser upward and a helical spring positioned in the region 318 can push the laser toward the opening, where a setscrew is mounted at 320. A similar type of arrangement can be used for the other laser. As further shown in this Fig., there is a magazine release 325, which is configured to fit within the frame at the magazine release opening 327.

Figure 20:
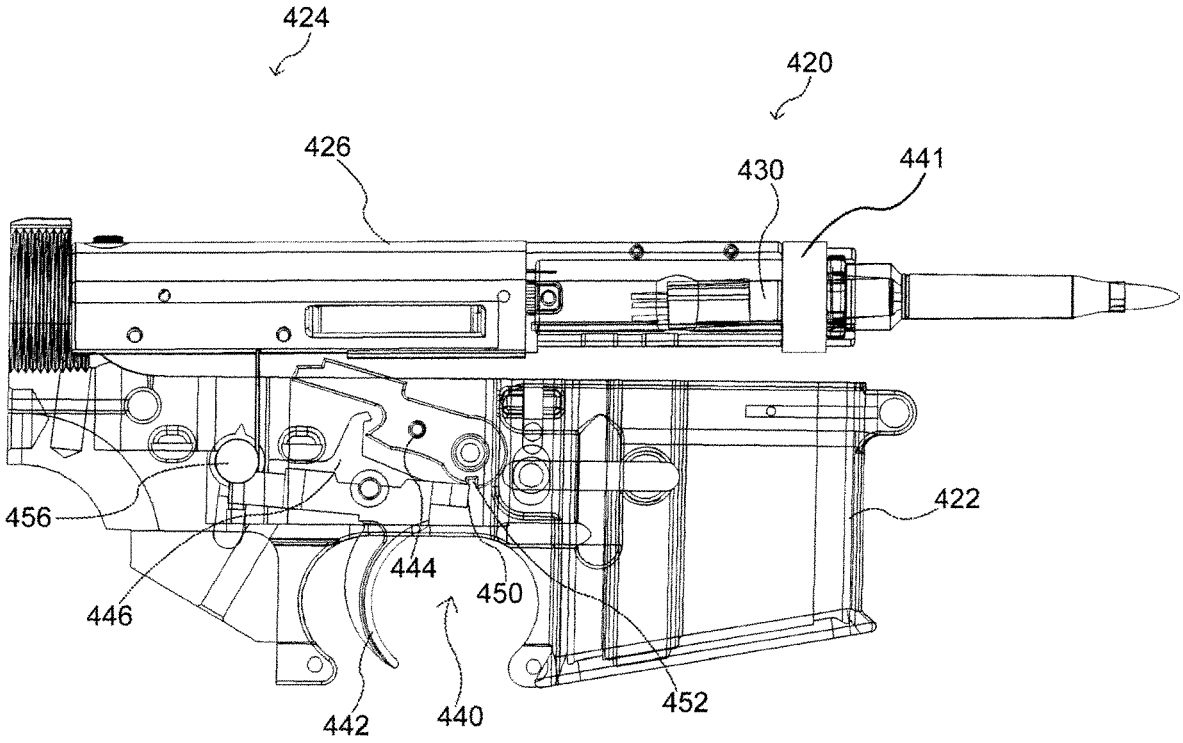
FIG. 20 shows one form of a dry firing system that is used in, for example, a rifle assembly.
Figure 21:
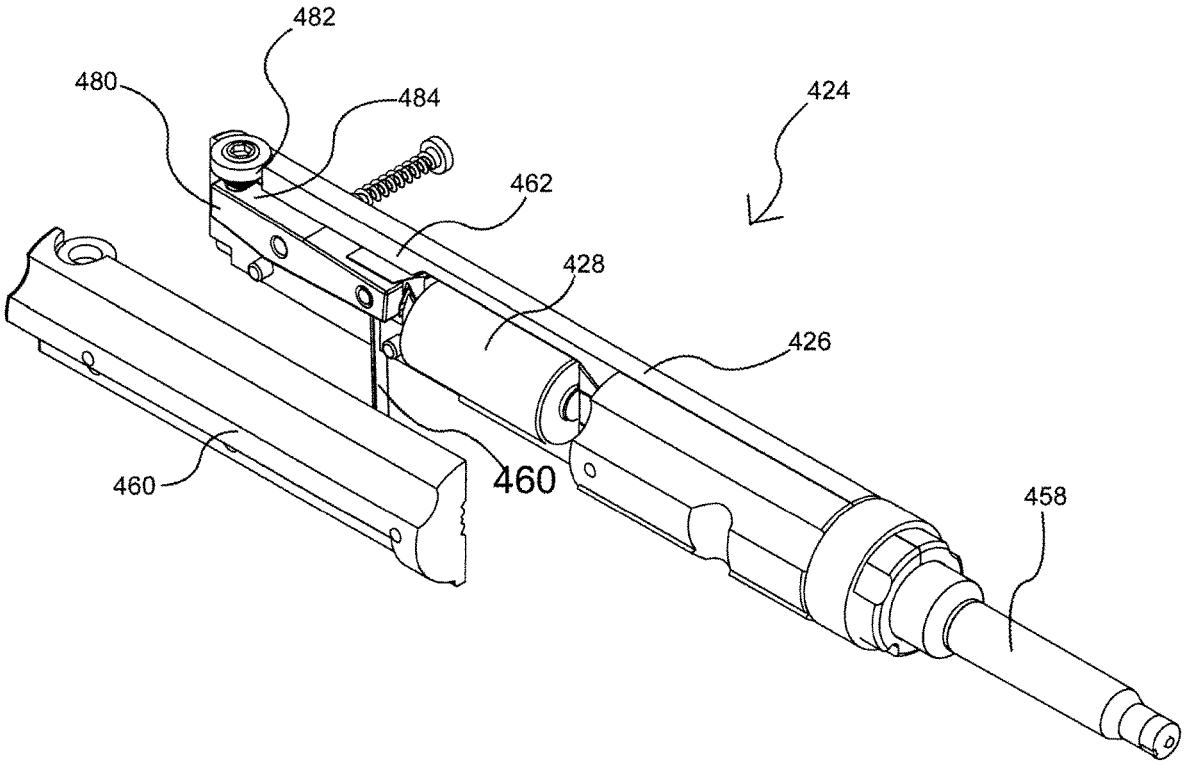
FIG. 21 shows a partially exploded view of a laser bolt configured to fit within an upper receiver.
Figure 22:
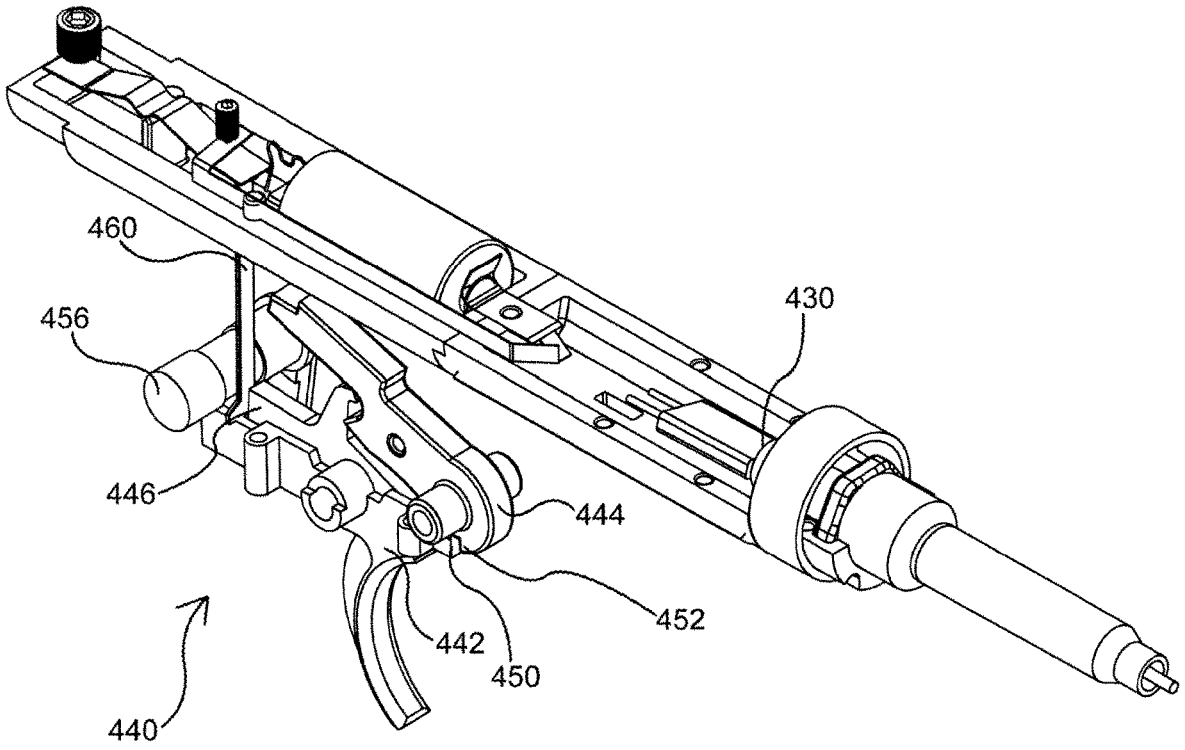
FIG. 22 shows a schematic view of a laser bolt interfacing with a trigger system.
Figure 23:
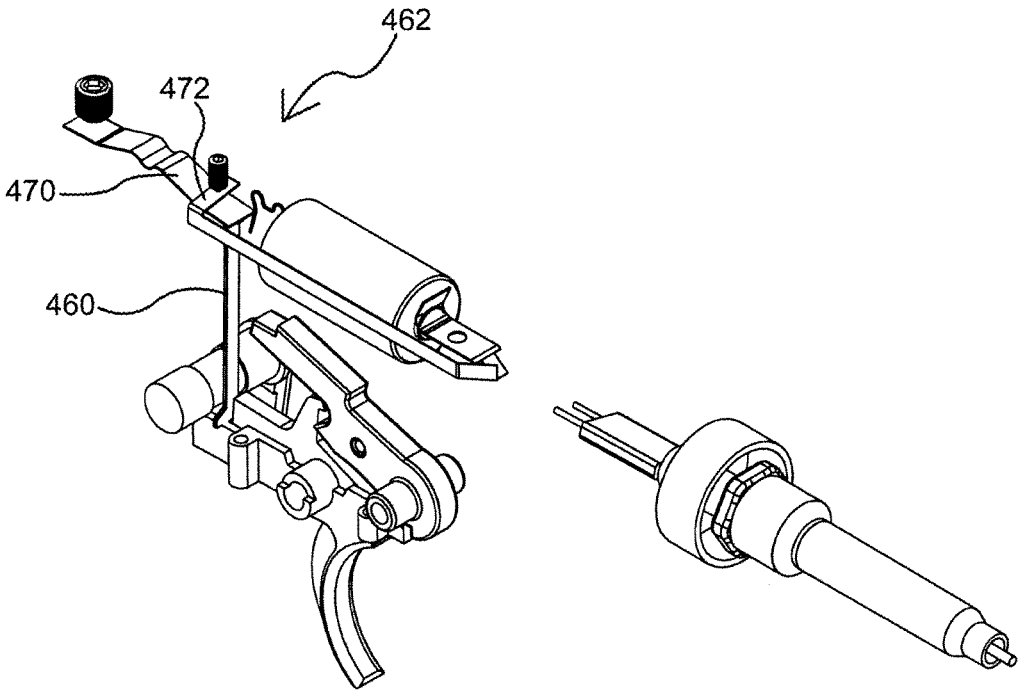
FIG. 23 shows a laser activation switch, shown in one form by way of example.

Now referring to FIG. 20, there is shown a dry fire system 420 where there is a lower receiver 422 and a laser bolt 424. The laser bolt is operably configured to fit within an upper receiver not shown in FIG. 20. As shown in FIG. 21, there is an isometric view of the laser bolt 424 where, in general, the laser bolt comprises a laser bolt housing 426, a power source 428 and a laser member 430 (as shown in FIG. 22). FIG. 22 further schematically shows a trigger system 440, which generally comprises trigger member 442, a hammer 444 and a disconnector 446. In general, the disconnector 446 is pivotally attached to the trigger and is configured to hold the hammer in a retained position when the trigger is fully pressed rearward. The trigger member 442 further comprises a trigger sear 450, which is operably configured to engage the hammer seer 452. In general, the trigger seer and hammer seer are configured to engage one another to retain the hammer in a retained "cocked" position, and when the trigger is pressed rearwardly the seer surfaces disengage from one another and the hammer is dropped to fire a round in the normal operation of a firearm. In general, as shown in FIG. 20, the trigger system 440 is pinned within the lower receiver 422. Although a trigger system can be removed from a lower receiver, this generally requires some effort on the part of the individual disassembling the trigger system. Therefore, in one form, it is desirable to have the trigger system 440 retained, within the lower receiver but yet utilize free motion of the trigger to simulate the firing sequence of a weapon, and in particular a rifle, which in one form is an AR15/M4. As shown in FIG. 20, it can be seen how the hammer 444 is rotated in a counterclockwise manner past any engagement orientation with the disconnector 446. Moreover, it can be seen that the seer surfaces, namely the trigger seer 450 and the hammer seer 452, are disengaged from one another, providing separation therebetween. This separation allows for movement of the trigger member 442. It should be noted that the trigger safety 456 is provided, in one form, in the lower receiver where the trigger safety operates to inhibit motion of the trigger to prevent firing. The trigger safety is well known in the art and in general is provided with an outer conical surface having a long, laterally extending flat edge that can be orientated in a manner so that there is greater range of motion of the trigger member to allow the firing sequence to be initiated.

Therefore, it can be appreciated that the laser bolt 424 is operably configured to reposition the hammer 444 downward to provide a greater degree of rotation of the trigger member 442. Now referring back to FIG. 22, it can be seen that there is a switch extension 460 that transfers force upward to the laser bolt to activate a laser activation switch 462. In one form, the switch extension 460 provides an upward force from rotation of the trigger 422, which closes the circuit in the laser bolt to activate the laser member 430. By way of general background, in one form of a weapon a bolt and carriage assembly is utilized, such as that fora HK rifles, G3, AR15 (as well as M4 and M16 and variants thereof) AK-47, SKS, MP5, SIG 556, FN, Galil, FALs and other firearms, in particular semiautomatic weapons with a bolt that can be removed. Therefore, by replacing the bolt and carriage assembly (or simply what is referred to as the bolt in some platforms) with the laser bolt 424, the shooter can use their upper assembly, which generally includes an upper receiver, barrel, and hand grip, as well as other paraphernalia, such as optics, sights, backup sights, rapid acquisition sights, such as red dot scopes, fore grips on the hand guard, lights, lasers and an array of other accessories now readily available for the rifle market. It should be reiterated that although a M4/AR15 system is shown by way of example, the spirit and scope of the disclosure is applicable to other systems such as the ones mentioned above. Of course, it is desirable for the shooter to train with his particular system, given that the idiosyncrasies of his system, such as the barrel weight, barrel length, and, of course, their particular optics, are critical for proper training. Therefore, it can be appreciated that the laser member 430 is operably configured to emit a laser beam, in particular a green laser beam in one preferred form, down the barrel of the gun to show the orientation of the muzzle of the barrel when the shot is broken. In one form, the laser activation switch 462 remains on when the trigger is depressed rearwardly. This shows the follow-through sweep of the laser when the trigger is fully pressed to further show the orientation of the muzzle during the shooter's follow-through of the trigger sequence.

As shown in FIG. 21, in one form the laser bolt 424 can comprise a chamber extension 458 attached to the laser bolt housing 426. In one form, a removable cover 460 is provided, which provides access to the power source 428. In one form, the power source can be a CR123 lithium battery, which generally has sufficient voltage and amperage to power a green 535-nanometer laser diode, which generally can require between 200 and 300 milliamps and 3 volts. In one form, the switch extension 460 closes the circuit of the laser activation switch 462 by way of a simple contact between the conductive members 470 and 472. As shown in FIG. 21, in one form, the simulated trigger break mechanism 480 can be provided where the simulated trigger break mechanism 480 rotates when the switch extension 460 presses upwardly and, in one form, a magnet 482 disengages from the metallic surface 484 to give a simulated breaking feel of the trigger.

Figure 24:
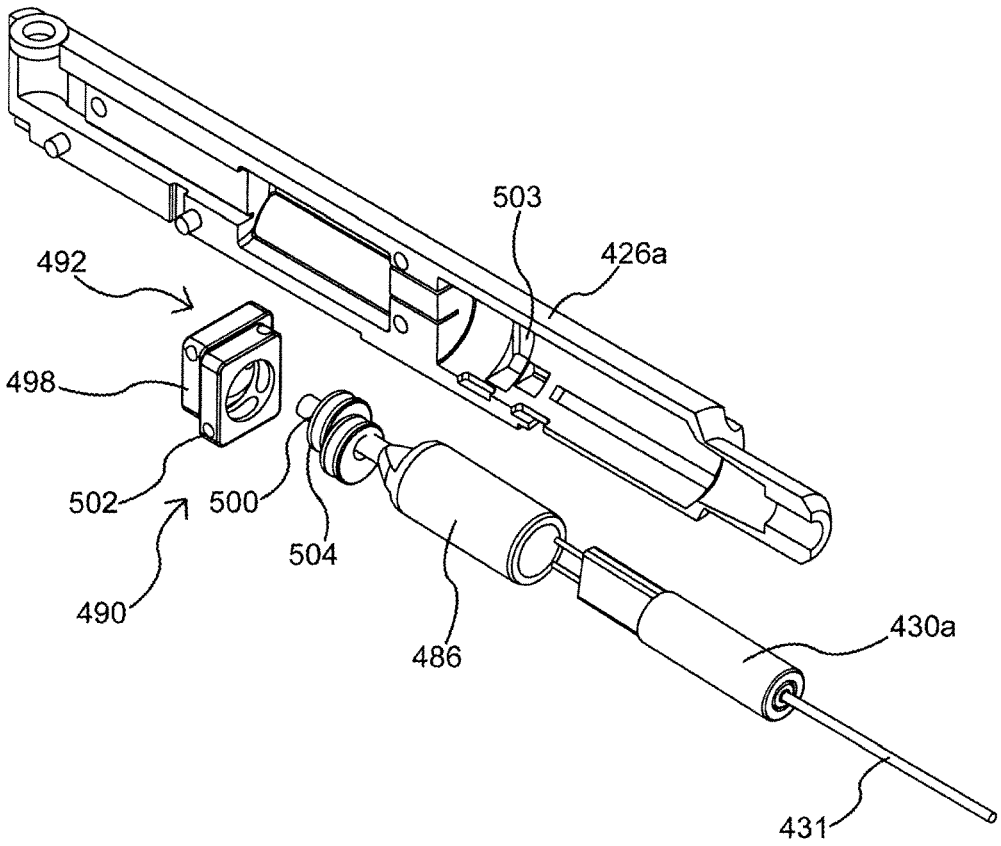
FIG. 24 shows another embodiment of a laser bolt having an adjustment system.
Figure 25:
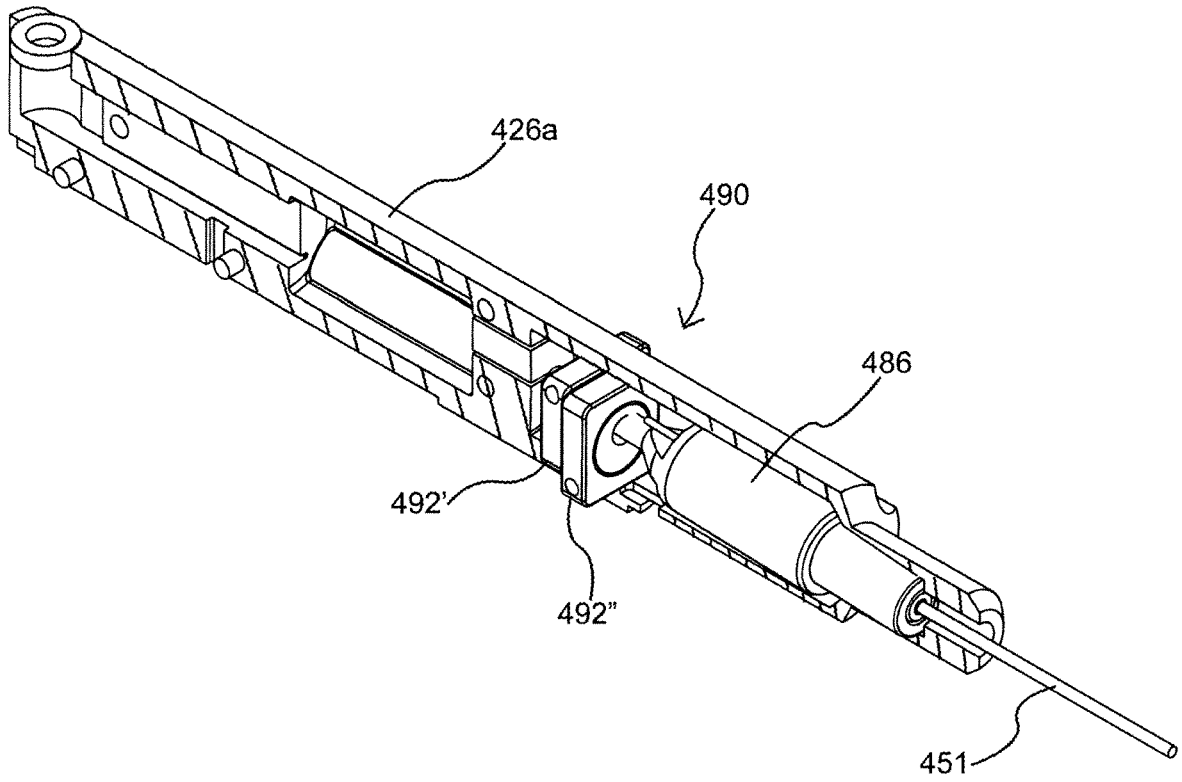
FIG. 25 shows a sectional view of the laser adjustment system in one form.
Figure 26:
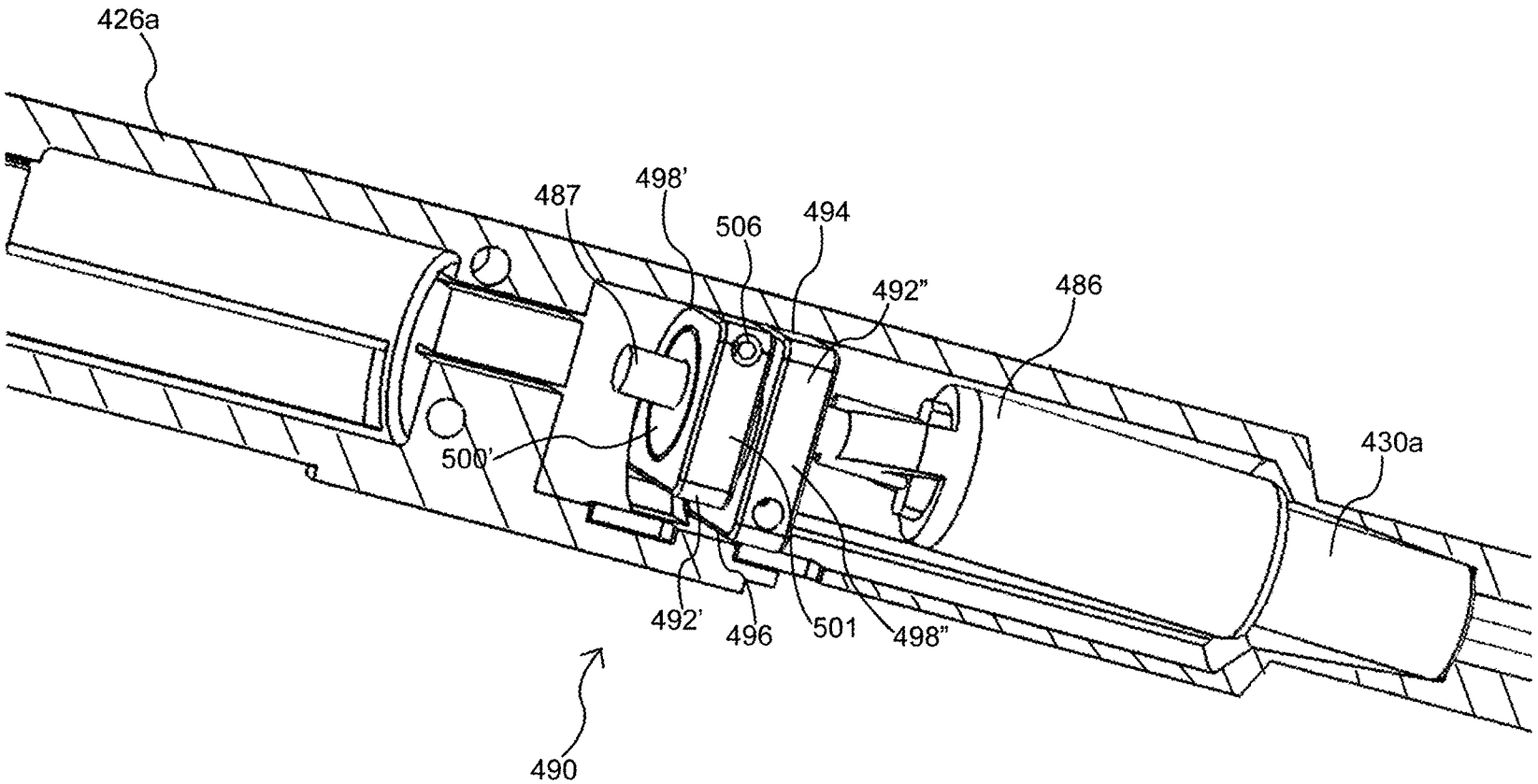
FIG. 26 shows a close-up view of one form of a laser adjustment system.

Now referring to FIG. 24, there is shown another embodiment where a laser bolt housing **426*a* is shown and the laser member 430*a* is housed within a laser housing 486. The laser adjustment system 490 is shown in one form. The laser adjustment system comprises first and second adjustment assemblies 492, which, in one form, are constructed in a very similar manner. The adjustment assemblies 492 cooperate with surfaces in or a part of the laser bolt housing 426*a* to provide prescribed motion vertically, only going up and down, and laterally, only going side to side. In other words, as shown in FIG. 26, the adjustment assembly 492' is configured to only reposition up and down. The adjustment assembly 492" is configured to only reposition left and right in a lateral direction, where it is constrained at upward and lower surfaces 494 and 496. As shown in FIG. 24, the adjustment assemblies 492 each comprise a pillow block 498 and a rotation block 500. The rotation blocks are configured to rotate within the pillow blocks, and the pillow blocks are provided with threaded openings 502 to allow a setscrew to pass therethrough. The outer annular grooves 504 of the rotation blocks have a partially threaded surface configured to engage a helical thread of a setscrew. Therefore, as shown in FIG. 26, when a setscrew 506 is rotated, the rotation block 500' rotates with respect to the pillow block 498'**.

With the above structural description in place, there will now be a general description of how the laser adjustment system 490 operates. In general, the laser member **430*a*, as shown in FIG. 24, must be adjusted with very fine movements, within a fraction of a degree, since the fine adjustments of the emitted laser beam, schematically shown at 431 in FIG. 24, must not hit the barrel as it exits the muzzle. However, fine adjustments are desirable so the laser beam 431 interfaces with some portion of the sites of the overall firearm. Therefore, to reposition the laser in very fine increments, as shown in FIG. 26, it can be appreciated that when the rotation block 500" rotates, the surrounding pillow block 498" can freely reposition up and down; however, the laser housing handle 487 will only reposition in the lateral direction (left and right). In other words, instead of the laser housing handle 487 moving in a circular pattern, the first and second adjustment assemblies 492' and 492" cooperatively operate to restrict the motion of the laser housing handle either strictly up and down or left and right. Continuing with the previous adjustment description, as the rotation block 500" continues to rotate, and of course assuming the rotation block within the adjustment assembly 492" does not rotate, the laser housing handle 487 will only move left or right. The laser housing handle 487 cannot move up or down because it is constrained to move up or down from the adjustment assembly 492". In other words, the upper and lower surfaces 494 and 496 of the adjustment assembly 492" restrict upward or downward movement. However, the adjustment assembly 492 as a whole can move left or right with respect to the laser bolt housing 426***a*. Because the adjustment assembly 492' cannot move left or right and is restricted from the lateral surfaces 501 (and an opposing lateral surface not shown) that closely engage a corresponding surface 503 of the laser bolt housing 426*a*, as shown in FIG. 24. Therefore, as the rotation block 500' rotates, the only constrained direction, for the laser housing handle 487 to move is in the lateral direction.

In a similar manner, if the laser is to be adjusted in the vertical direction, the rotation block of the adjustment assembly 492" (not shown in FIG. 26) is rotated, and because the surrounding pillow block 498" cannot move up or down but can move left or right, the laser housing handle 487 will reposition in a vertical direction. The adjustment assembly 492" is constrained from moving left or right but can freely move up and down, so it can be appreciated that the two adjustment assemblies 492' and 492" operate cooperatively to adjust the laser housing 486, which in turn adjusts the orientation of the laser 430*a*. It should further be noted that the setscrews positioned within the laser adjustment system 490 can be accessible through the ejection port of an upper receiver, in one preferred form. That way, when the laser bolt is inserted into, for example, an upper receiver of an AR15 platform gun, the fine adjustments of the laser can then be made to orient the laser with a desired position of the sliding system or optic of the upper receiver.

Another embodiment is shown below where a lower receiver is replaced with an inert lower receiver, and an auto-resetting trigger cooperates with a laser bolt to activate the laser when the trigger is pressed.

Figure 27:
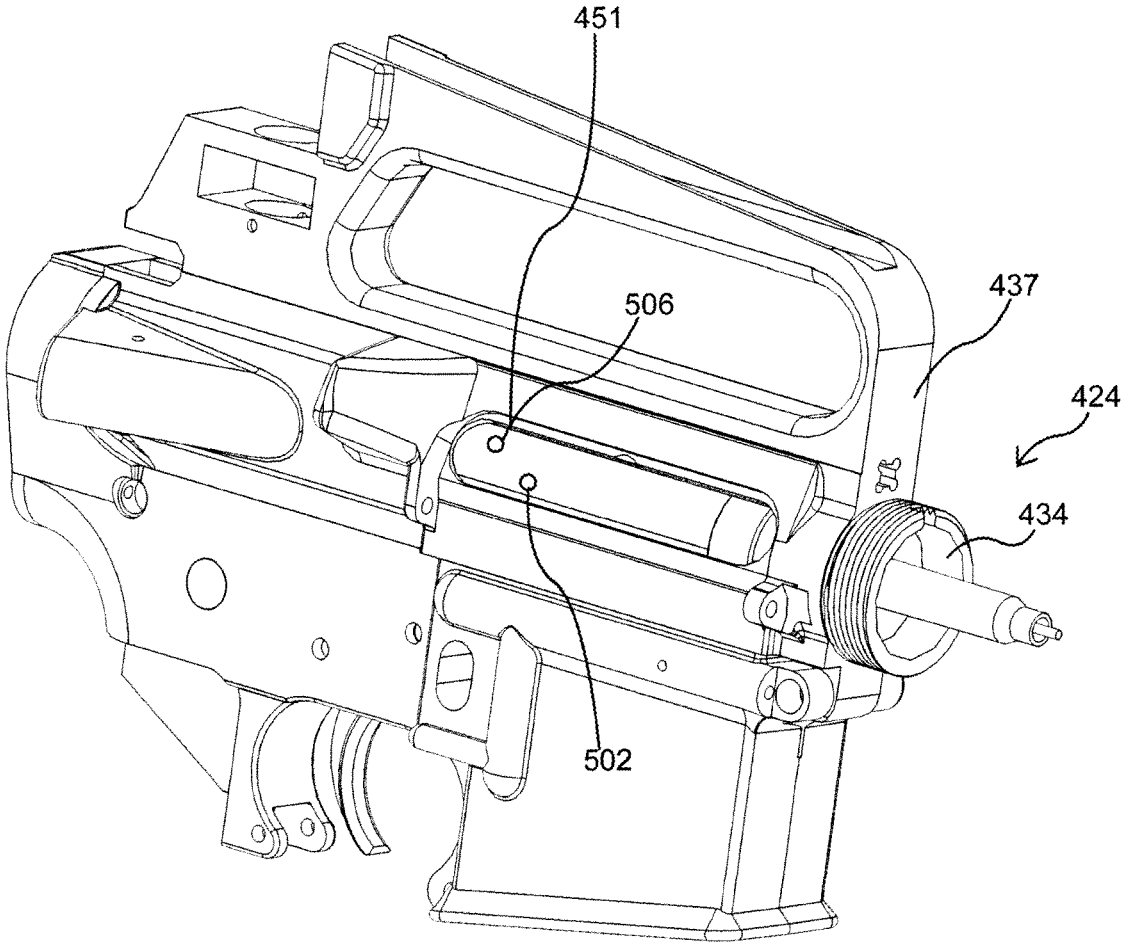
FIG. 27 shows an example of an upper receiver having a laser bolt fitted therein, where the ejection port is shown providing access to an adjustment system.

As shown in FIG. 27, there is the front portion of the laser bolt 424, which in one form is configured to extend within the chamber of a barrel (not shown) that is rigidly attached to the upper receiver 437. As described above, the laser bolt is configured to fit within the interior chamber 439 of the upper receiver. In one form, a locking mechanism is utilized in one of a variety of forms where, referring back to FIG. 20, a rotating-type lock 441 can be utilized to rigidly position the laser bolt 424 with respect to the upper receiver 437 (shown in FIG. 27). It should further be noted that the upper receiver has a surface defining an ejection port 451, which in normal operation is an opening for allowing ejected brass to pass therethrough during a firing sequence. However, the adjustment assembly 492, such that shown in FIG. 24, is operably configured to provide access to the setscrew or other form of adjustment access mechanisms to adjust the orientation of the laser while the laser bolt is assembled to the upper receiver.

Figure 28:
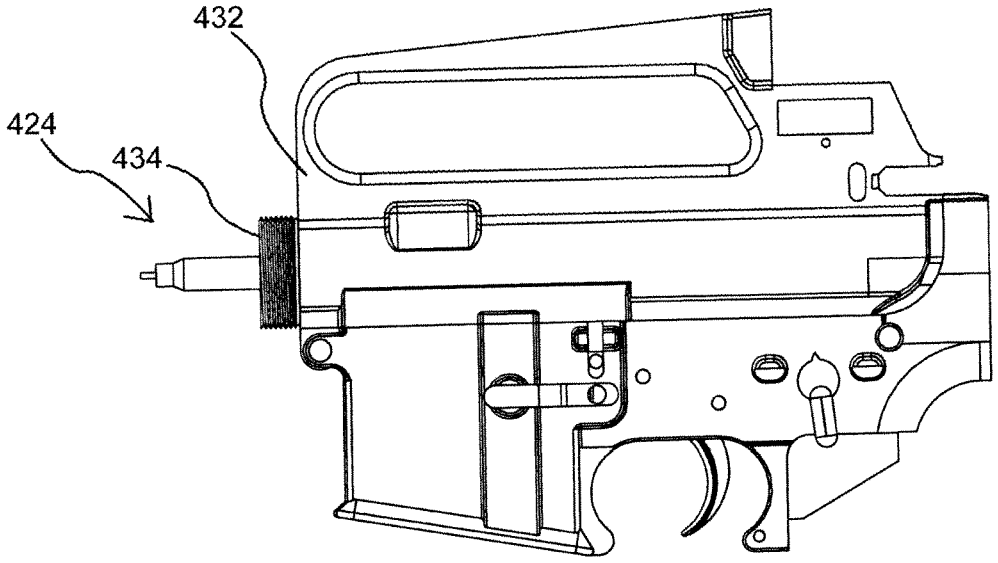
FIG. 28 shows an opposing side view of an upper receiver attached to a lower receiver, where the laser bolt can operate in this environment in one form, as well as other rifle systems (and in some pistol systems, such as the Diplomat™)
Figure 29:
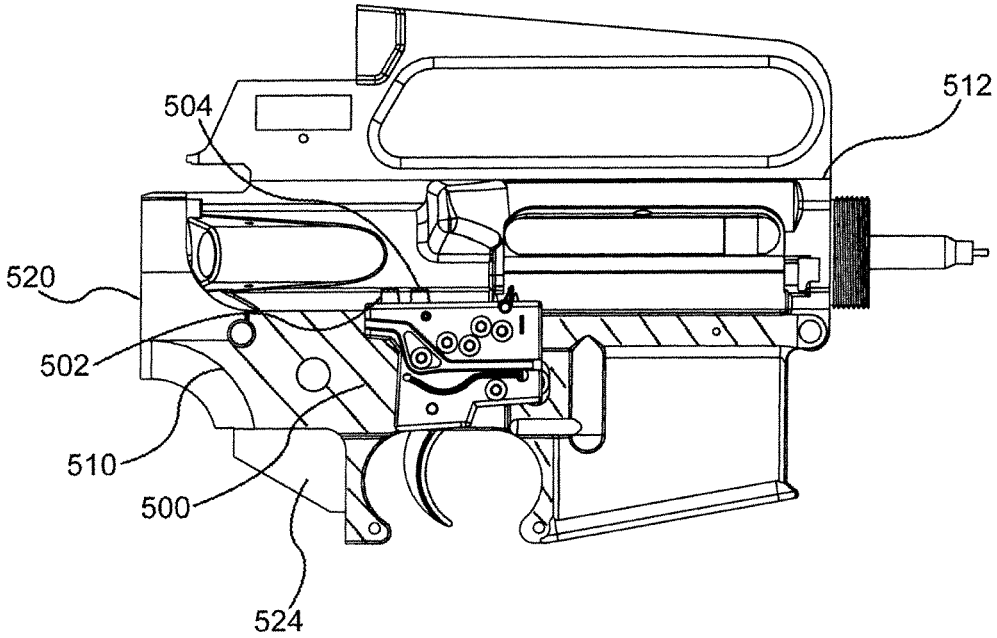
FIG. 29 shows another embodiment where an adjustable trigger is utilized in an inert lower receiver, which is operably configured to be attached to an upper receiver.

FIG. 28 shows a side view from the left hand side of the lower and upper receivers. FIG. 29 shows another embodiment where a trigger module 500 is shown. In general, the trigger module 500 can be an adjustable trigger and is provided with electrical contacts 502 and 504. Basically, when the trigger module 500 breaks and closes the switch, there is an electrical shortage between the electrical contacts 502 and 504, effectively closing the circuit and activating the laser. In this form, the inert lower receiver 510 is operatively configured to be attached to the upper receiver 512. In this form, the inert lower receiver 510 can accept magazines to do mag changes. However, because the lower receiver 510 is inert and cannot be made to fire when attached to an upper receiver, the entire system is not considered a firearm for training purposes and storage in arms rooms. In general, the lower receiver has the attachment locations 524 and 526 to attach grips and butt stocks.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

What is claimed is:

1. A dry fire system in a firearm for training, comprising:
an upper receiver having a laser mounted thereto;
an inert lower receiver having a switch, the inert lower receiver operatively configured to be mounted to an upper receiver; and
a trigger module mounted in the inert lower receiver, the trigger module having a trigger and configured to close the switch in the inert lower receiver, wherein the trigger, when pressed rearward within the trigger module, closes the switch and only activates the laser and not fire the firearm.

2. The dry fire system as recited in claim 1, wherein the inert lower receiver adapted to accept magazines to train magazine changes.

3. The dry fire system as recited in claim 1, wherein the laser stays on when the trigger is pressed rearwardly.

4. The dry fire system as recited in claim 1, wherein the laser is mounted to align an output laser down a barrel mounted to the upper receiver.

5. The dry fire system as recited in claim 4, wherein the laser stays on when the trigger is pressed rearwardly.

6. The dry fire system as recited in claim 1, wherein the upper receiver is one of the following: a HK rifles, G3, AR15, M4, M16, AK-47, SKS, MP5, SIG 556, FN, Galil, or FAL.

7. The dry fire system as recited in claim 1, wherein the trigger module is an adjustable trigger comprising electrical contacts to activate the laser when the switch is closed.

8. The dry fire system as recited in claim 1, wherein the inert lower receiver comprises attachments location to attach grips and butt stocks.

9. A method for operating a dry fire system in a firearm for training, the method comprising:
handling the dry fire system comprising:
an upper receiver having a laser mounted thereto;
an inert lower receiver having a switch, the inert lower receiver operatively configured to be mounted to an upper receiver; and
a trigger module mounted in the inert lower receiver, the trigger module having a trigger and configured to close the switch in the inert lower receiver,
pressing the trigger rearwardly within the trigger module to close the switch and only activate the laser and not fire the firearm.

10. The method as recited in claim 9, wherein the inert lower receiver adapted to accept magazines to train magazine changes.

11. The method as recited in claim 9, wherein pressing the trigger rearwardly enables the laser stays.

12. The method as recited in claim 9, wherein the laser is mounted to align an output laser down a barrel mounted to the upper receiver.

13. The method as recited in claim 9, wherein the trigger module is an adjustable trigger comprising electrical contacts to activate the laser when the switch is closed.

* * * * *